US006918230B2

(12) United States Patent
Thieman

(10) Patent No.: US 6,918,230 B2
(45) Date of Patent: Jul. 19, 2005

(54) METHOD AND APPARATUS FOR PLACING A PRODUCT IN A FLEXIBLE RECLOSEABLE CONTAINER

(75) Inventor: Ronald G. Thieman, Noblesville, IN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/325,483

(22) Filed: Dec. 19, 2002

(65) Prior Publication Data

US 2003/0220179 A1 Nov. 27, 2003

Related U.S. Application Data

(63) Continuation of application No. 10/232,844, filed on Aug. 30, 2002, which is a continuation of application No. 09/794,592, filed on Feb. 27, 2001, now Pat. No. 6,499,272, which is a continuation of application No. 09/493,718, filed on Jan. 28, 2000, now Pat. No. 6,216,423, and a continuation-in-part of application No. 09/370,053, filed on Aug. 6, 1999, now Pat. No. 6,209,287, which is a continuation of application No. 08/965,722, filed on Nov. 7, 1997, now Pat. No. 5,956,924.

(60) Provisional application No. 60/148,495, filed on Aug. 12, 1999.

(51) Int. Cl.[7] ..... B65B 61/18

(52) U.S. Cl. ..... 53/412

(58) Field of Search ..... 53/412, 450, 416, 53/451, 133.4, 139, 550, 551, 552; 493/213, 214, 215, 927

(56) References Cited

U.S. PATENT DOCUMENTS

| | | | |
|---|---|---|---|
| 3,202,559 | A | 8/1965 | Laguerre |
| 3,426,396 | A | 2/1969 | Laguerre |
| 3,701,191 | A | 10/1972 | Laguerre |
| 4,199,845 | A | 4/1980 | Ausnit |
| 4,241,865 | A | 12/1980 | Ferrell |

(Continued)

FOREIGN PATENT DOCUMENTS

| | | |
|---|---|---|
| EP | 0 098 392 A1 | 4/1999 |
| EP | 0 689 993 | 4/1999 |
| GB | 2 085 519 A | 4/1982 |
| WO | WO 98/57863 | 12/1998 |
| WO | WO 99/36325 | 7/1999 |
| WO | WO 99/56947 | 11/1999 |
| WO | WO 99/65353 | 12/1999 |
| WO | WO 00/02722 | 1/2000 |

*Primary Examiner*—John Paradiso
(74) *Attorney, Agent, or Firm*—John H. Pilarski; Mark W. Croll

(57) ABSTRACT

Apparatus and methods for forming, filling, and sealing a flexible recloseable container. Both vertical and horizontal methods for placing product within the container are disclosed. The invention includes guiding a web of film which has interlocking fastener strips sealed to the web. A slider for locking and unlocking the fastener strips is placed in the correct orientation, spread apart at a pair of inner feet, and inserted over the fastener strips. The slider is positioned to close a substantial portion of the strips, and then an end stop, docking station, and corner seal are formed against a sealing plate. The slider is then repositioned, and a tamper evident seal may be placed over the fastener strip.

Apparatus and methods for placing a product in a flexible recloseable container, and also for manufacturing an empty, flexible recloseable container. One method includes providing a pair of interlockable fastener strips, a web of flexible film, and a plurality of sliders, placing the sliders on the pair of interlockable fastener strips, subsequently attaching the interlockable fastener strips with attached sliders to the web of flexible film, and either placing a product within the web or providing the empty container to the consumer.

4 Claims, 28 Drawing Sheets

U.S. PATENT DOCUMENTS 4,262,395 A 4/1981 Kosky
4,415,386 A 11/1983 Ferrell et al.
4,581,006 A 4/1986 Hugues et al.
4,874,257 A 10/1989 Inagaki
4,890,935 A 1/1990 Ausnit et al.
4,894,975 A 1/1990 Ausnit
4,945,714 A 8/1990 Bodolay et al.
5,007,142 A 4/1991 Herrington
5,007,143 A 4/1991 Herrington
5,010,627 A 4/1991 Herrington et al.
5,020,194 A 6/1991 Herrington et al.
5,024,537 A 6/1991 Tilman
5,063,644 A 11/1991 Herrington et al.
5,067,208 A 11/1991 Herrington, Jr. et al.
5,070,583 A 12/1991 Herrington
5,085,031 A 2/1992 McDonald
5,088,971 A 2/1992 Herrington
5,103,546 A 4/1992 Rossini et al.
5,131,121 A 7/1992 Herrington, Jr. et al.
5,140,796 A 8/1992 Pope
5,152,613 A 10/1992 Herrington, Jr.
5,161,286 A 11/1992 Herrington, Jr. et al.
5,167,608 A 12/1992 Steffens, Jr. et al.
5,179,816 A 1/1993 Wojnicki
5,189,764 A 3/1993 Herrington et al.
5,211,482 A 5/1993 Tilman
5,247,781 A 9/1993 Runge
5,283,932 A 2/1994 Richardson et al.
5,301,394 A 4/1994 Richardson et al.
5,301,395 A 4/1994 Richardson et al.
5,400,568 A 3/1995 Kanemisue et al.
5,405,478 A 4/1995 Richardson et al.
5,417,035 A 5/1995 English
5,425,216 A 6/1995 Ausnit
5,426,830 A 6/1995 Richardson et al.
5,431,760 A 7/1995 Donovan
5,435,864 A 7/1995 Machacek et al.
5,442,838 A 8/1995 Richardson et al.
5,448,807 A 9/1995 Herrington, Jr.
5,448,808 A 9/1995 Gross
5,461,845 A 10/1995 Yeager
5,482,375 A 1/1996 Richardson et al.
5,505,037 A 4/1996 Terminella et al.
5,525,363 A 6/1996 Herber et al.
5,557,907 A 9/1996 Malin et al.
5,561,996 A 10/1996 Chang
5,622,431 A 4/1997 Simonsen
5,638,586 A 6/1997 Malin et al.
5,664,299 A 9/1997 Porchia et al.
5,669,715 A 9/1997 Dobreski et al.
5,722,128 A 3/1998 Toney et al.
5,775,812 A 7/1998 St. Phillips et al.
5,809,621 A 9/1998 McCree et al.
5,816,018 A 10/1998 Bois
5,826,401 A 10/1998 Bois
5,833,791 A 11/1998 Bryniarski et al.
5,836,056 A 11/1998 Porchia et al.
5,857,310 A 1/1999 Bois
5,867,875 A 2/1999 Beck et al.
5,884,452 A 3/1999 Bois
5,896,627 A 4/1999 Cappel et al.
5,938,337 A 8/1999 Provan et al.
5,951,453 A 9/1999 Yeager
5,953,796 A 9/1999 McMahon et al.
5,956,924 A 9/1999 Thieman
6,000,197 A 12/1999 Ausnit
6,003,582 A 12/1999 Blohowiak et al.
6,012,264 A 1/2000 Linkiewicz
6,032,437 A 3/2000 Bois
6,071,011 A 6/2000 Thomas et al.
6,085,491 A 7/2000 Bois
6,088,887 A 7/2000 Bois
6,110,090 A 8/2000 Ausnit
6,110,586 A 8/2000 Johnson
6,115,892 A 9/2000 Malin et al.
6,117,060 A 9/2000 Bodolay
6,131,369 A 10/2000 Ausnit
6,131,370 A 10/2000 Ausnit
6,131,374 A 10/2000 Bois
6,138,439 A 10/2000 McMahan et al.
6,161,271 A 12/2000 Schreiter
6,178,722 B1 1/2001 McMahon
6,199,256 B1 3/2001 Revnew et al.
6,209,287 B1 4/2001 Thieman
6,212,857 B1 4/2001 Van Erden
6,213,640 B1 4/2001 Bois
6,216,423 B1 4/2001 Thieman
6,244,021 B1 6/2001 Ausnit et al.
6,261,000 B1 7/2001 Bois
6,279,298 B1 8/2001 Thomas et al.
6,286,189 B1 9/2001 Provan et al.
6,286,999 B1 9/2001 Cappel et al.
6,289,561 B1 9/2001 Provan et al.
6,292,986 B1 9/2001 Provan et al.
6,293,896 B1 9/2001 Buchman
6,305,844 B1 10/2001 Bois
6,327,754 B1 12/2001 Belmont et al.
6,334,709 B1 1/2002 Bois
6,339,911 B2 1/2002 Bois
6,343,455 B2 2/2002 Bois
6,376,035 B1 4/2002 Dobreski et al.
2001/0002504 A1 6/2001 Provan et al.
2001/0005973 A1 7/2001 Schneider et al.

METHOD AND APPARATUS FOR PLACING A PRODUCT IN A FLEXIBLE RECLOSEABLE CONTAINER

CROSS REFERENCE TO RELATED APPLICATIONS

This application is a continuation of U.S. patent application Ser. No. 10/232,844, filed Aug. 30, 2002, which is a continuation of U.S. patent application Ser. No. 09/794,592, filed Feb. 27, 2001 now U.S. Pat. No. 6,499,272; which is a continuation of U.S. patent application Ser. No. 09/493,718, filed Jan. 28, 2000 which is now U.S. Pat. No. 6,216,423; which claims priority to U.S. Provisional Patent Application Ser. No. 60/148,495, filed Aug. 12, 1999, and which is a continuation-in-part of U.S. patent application Ser. No. 09/370,053, filed Aug. 6, 1999 which is now U.S. Pat. No. 6,209,287, which is a continuation of U.S. patent application Ser. No. 08/965,722, filed Nov. 7, 1997, which is now U.S. Pat. No. 5,956,924. All of these documents are incorporated herein by reference.

BACKGROUND OF THE INVENTION

The present invention relates to methods and apparatus for placing a product in a flexible, recloseable container, and methods and apparatus for manufacturing a flexible, recloseable container. More specifically, the present invention relates to the use of sliders on profiles used with flexible recloseable containers.

Flexible, recloseable containers such as zipper-type plastic bags are a significant advancement in the field of prepackaged items both for industrial and retail uses. The packaging industry recognizes the importance of using interlocking fastener profile strips to provide the ability to reclose the container after first use. It is also important that it be easy for the user to reliably close the interlocking strips. For instance, some containers utilize multi-colored interlocking strips to make it easier for the consumer to determine if a container is closed. Another way in which to provide for reliable interlocking is by the use of a slider that opens the interlocks when moved in one direction, and closes the interlocks when moved in the other direction. Sliders have not been applied to flexible, recloseable containers being filled with a product on a form, fill, and seal machine. What is needed is a method for incorporating a slider on a flexible, recloseable container that is formed, automatically filled with a product, and sealed. The present invention provides this in a novel and unobvious way.

SUMMARY OF THE INVENTION

One aspect of the present invention provides a method for placing the product in a flexible recloseable container. The method includes feeding a web of flexible film with interlockable fastener strips. A slider is oriented to a predetermined orientation, and placed over the fastener strips. The slider is moved relative to the fastener strips such that the fastener strips are generally closed. A transverse seal is generally formed across the film and a product is placed within the web.

Another aspect of the present invention provides a method for making a flexible recloseable container. The method includes providing a pair of interlockable fastener strips, a web of flexible film, and a slider, placing the slider on the pair of interlockable fastener strips, and then attaching the interlockable fastener strips with attached sliders to the web of flexible film.

This and other objects of the present invention will be found in the claims, description, and drawings of the embodiments of the present invention to follow.

DESCRIPTION OF THE PREFERRED EMBODIMENT

Figure 1:
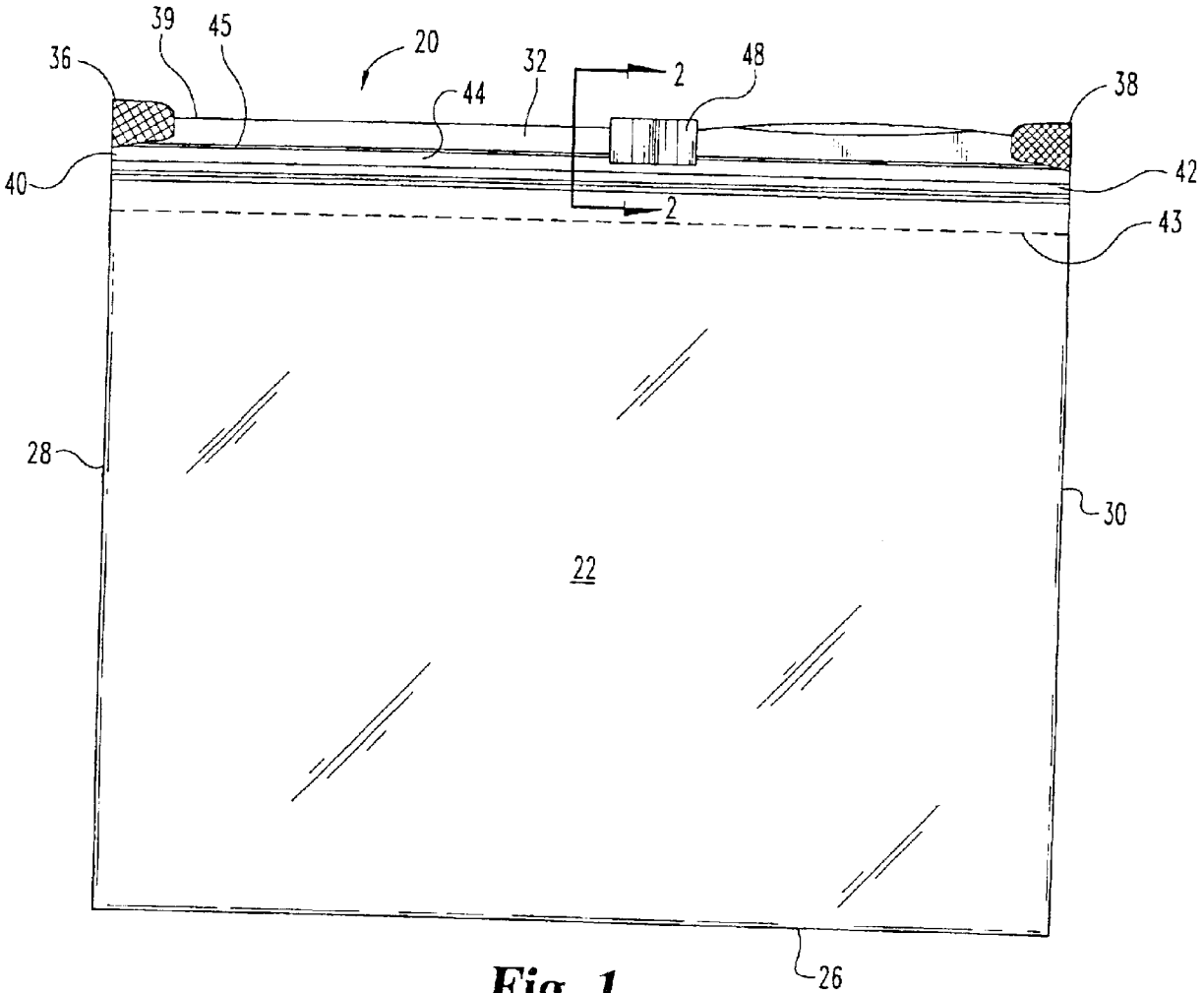
FIG. 1 shows a flexible recloseable container for containing a product, the container being suitable for being formed, filled, and sealed in several embodiments of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
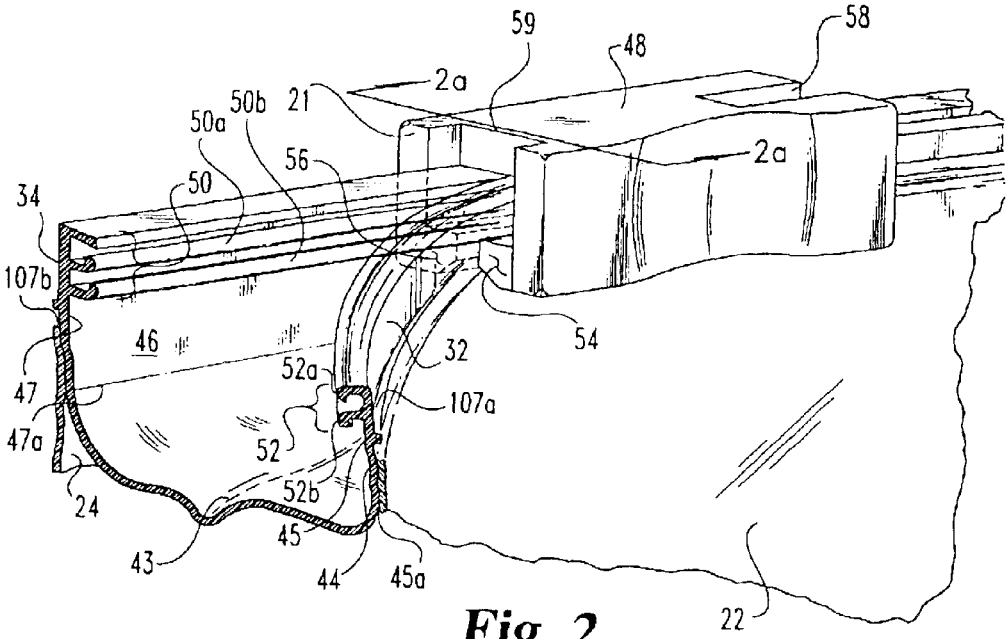
FIG. 2 is an enlarged perspective fragmentary cross sectional view of the container of FIG. 1 as taken along line 2—2 of FIG. 1, with one sidewall partially peeled away from the other sidewall.

FIGS. 1 and 2 show a flexible recloseable container 20 for containing a product, container 20 useful for being formed, filled, and sealed in several embodiments of the present invention. Container 20 comprises first and second sidewalls 22 and 24, respectively, which may be made from any suitable thermoplastic film such as, for example, low density polyethylene, linear low density polyethylene, or similar materials. Sidewalls 22 and 24 include first left transverse side seal 28 and second right transverse side seal 30. Container 20 also includes a bottom edge 26 generally opposite a pair of interlocking fastener strips 32 and 34. Bottom edge 26 may include a fold between sidewalls 22 and 24, such as for a container formed using some embodiments of a vertical form, fill and seal apparatus, or alternatively edge 26 may include a seal between sidewalls 22 and 24, such as for a container 20 formed using other embodiments of a horizontal form, fill, and seal apparatus.

FIG. 2 is an enlarged cross section of the container of FIG. 1 as taken along line 2—2 of FIG. 1 with sidewall 22 partially peeled away from sidewall 24. As shown in both FIGS. 1 and 2, interlocking strips 32 and 34 of fastener profiles run along the top edge of container 20. Strips 32 and 34 are sealed together at endstops 36 and 38. A docking station 39 is located near endstop 36. Strips 32 and 34 are sealed to each other and also to sidewalls 22 and 24 at corner seals 40 and 42. Corner seals 40 and 42 are located along their respective edges of container 20. Seals 40 and 42 are generally located below shoulders 45 and 47 of fastener strips 32 and 34, respectively, and above lower edges 45*a* and 47*a* of inner flanges 44 and 46 of fastener strips 32 and 34, respectively. In one embodiment of the present invention, container 20 includes a tamper-evident seal 43 between sidewalls 22 and 24. Seal 43 may be an extension of flanges 46 and 44 that extends internally across the opening of container 20. Seal 43 may be integrally molded with flanges 44 and 46, or may be attached separately. The broken or unbroken state of seal 43 provides evidence to the user of whether or not container 20 has been previously opened. A tamper evident seal is especially useful with a form, fill, and seal machine that inserts an edible product into container 20.

Slider 48 is slidable upon fastener strips 32 and 34. Movement of slider 48 along the fastener profiles results in either an interlocking of profiles 50 and 52, or an unlocking of profiles 50 and 52. In some embodiments of the present invention profiles 50 and 52 are comprised of uppermost and bottommost closure elements. In one embodiment there is an uppermost closure element 50*a* that interlocks with uppermost closure element 52*a*, and a bottommost closure element 50*b* that interlocks with bottommost closure element 52*b*. In a more preferable embodiment of the present invention separator 60 has a length sufficient to separate elements 50*a* and 52*a*, and its length is otherwise kept to a minimum. In this manner, separator 60 is kept from interfering with any spreading devices of slider application machine 114. It is preferable that slider 48 be cast or molded as a single piece, such that subsequent spreading of slider 48 by slider application machine 114 does not unduly stress a joint between separate slider components.

Figure 2A:
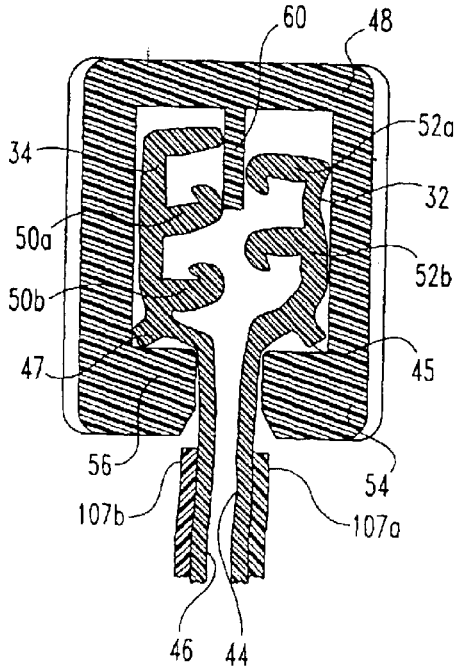
FIG. 2*a* is a partial cross-sectional view of the container of FIG. 2 as taken along line 2*a*–2*a* of FIG. 2.

FIG. 2*a* is a partial cross-sectional view of the container of FIG. 2 as taken along line 2*a*—2*a* of FIG. 2. Slider 48 is shown enclosing non-interlocked portions of fastener strips 34 and 32. A separator 60 separates closure elements 50*a* and 52*a*. Feet 54 and 56 of slider 48 retain slider 48 on the interlocking strips by shoulders 45 and 47, respectively.

Figure 3:
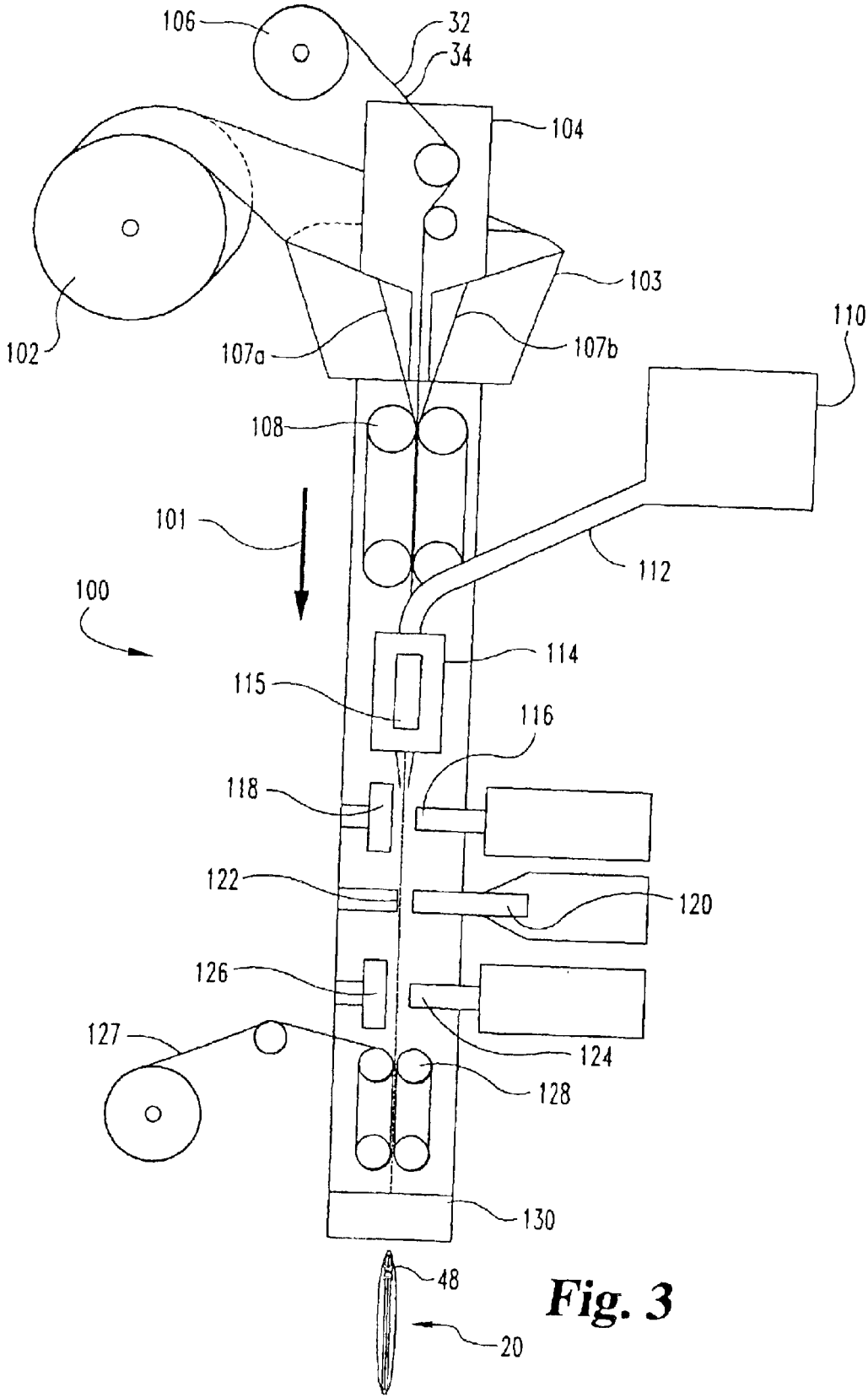
FIG. 3 is a schematic representation of apparatus 100, one embodiment of the present invention, for forming, filling, and sealing a container in a substantially vertical manner.

FIG. 3 is a schematic representation of apparatus 100, one embodiment of the present invention. Apparatus 100 is useful for forming, filling, and sealing a flexible recloseable container such as, for example, container 20 in a generally vertical orientation. Apparatus 100 includes rollers, belts, or similar devices for feeding film web 102 to a film guide 103 that accepts the sheet of web 102 and forms it into a generally tubular shape over the outside of filling tube 104, with web 102 proceeding in a direction as indicated by arrow 101. The supply 102 of film web is in a sheet form, as depicted.

Interlocking strips 32 and 34 of fastener profile are provided from a supply 106. Alternatively, some embodiments of the present invention include interlocking strips 32 and 34 which have previously been made integral with web 102. Strips 32 and 34 are substantially interlocked as provided, and pass over one or more guiding and tensioning rollers, and then between free edges 107*a* and 107*b* of web 102. Sealing mechanism 108 forms a continuous seal along edge 107*a* of web 102 and fastener strip 32, including a portion of inner flange 44. Sealing mechanism 108 is preferably of a type that utilizes any of hot air, heated metal bars, electrical impulse sealing bars, or ultrasonics. It is preferable that edge 107*a* seal against and overlap flange 44 and not shoulder 45. Likewise, free edge 107*b* is sealed along inner flange 46 of fastener strip 34, and preferably does not overlap shoulder 47, although there may be overlapping of the free edge and the shoulder in some embodiments of the present invention. In a more preferable embodiment of the present invention, strips 32 and 34 are oriented relative to edges 107*a* and 107*b*, respectively, such that free edges 107*a* and 107*b* are not between feet 54 and 56, respectively, so as to facilitate placement of slider 48 on strips 32 and 34 by slider application machine 114.

A vibrating bowl or hopper 110 provides sliders 48 to channel 112 in an orientation appropriate for insertion of slider 48 onto fastener strips 32 and 34. Slider 48 is preferably oriented on fastener strips 32 and 34 such that the more narrow, interlocking end 58 of slider 48 faces in direction of the movement 101 of film web 102. The wider, unlocking end 59 of slider 48 is thus oriented opposite to direction of motion 101. Channel 112 provides sliders 34 to slider application machine 114. The present invention also contemplates those embodiments in which unlocking end 59 is oriented to face in the direction of movement 101.

Slider application machine 114 includes a motor-driven rotating selector wheel 115 which rotates within a semi-circular pocket of mounting block 302. Selector 115 rotates in a direction indicated by arrow 304 about axis of rotation 306. Sidewalls 22 and 24 of web 102, with fastener strips 32 and 34 attached, move in direction 101. A stationary probe 309 spreads apart fastener strips 32 and 34 as the strips move toward slider application machine 114. Probe 309 is shown extending from channel 112 and preferably passing between both sets of closure elements 50*a* and 52*a*, and 50*b* and 52*b*. However, it is also acceptable in some embodiments of the present invention that probe 309 extend only between top closure elements 50*a* and 52*a*. In this manner the bottom closure elements remain interlocked, and slider 48 need not be spread apart as much to pass over the bottom closure elements 50*b* and 52*b*. This partial opening by probe 309 would be useful in those embodiments of the present invention that utilize sliders 48 that cannot be spread apart far enough to extend over the bottom closure elements.

Figure 4:
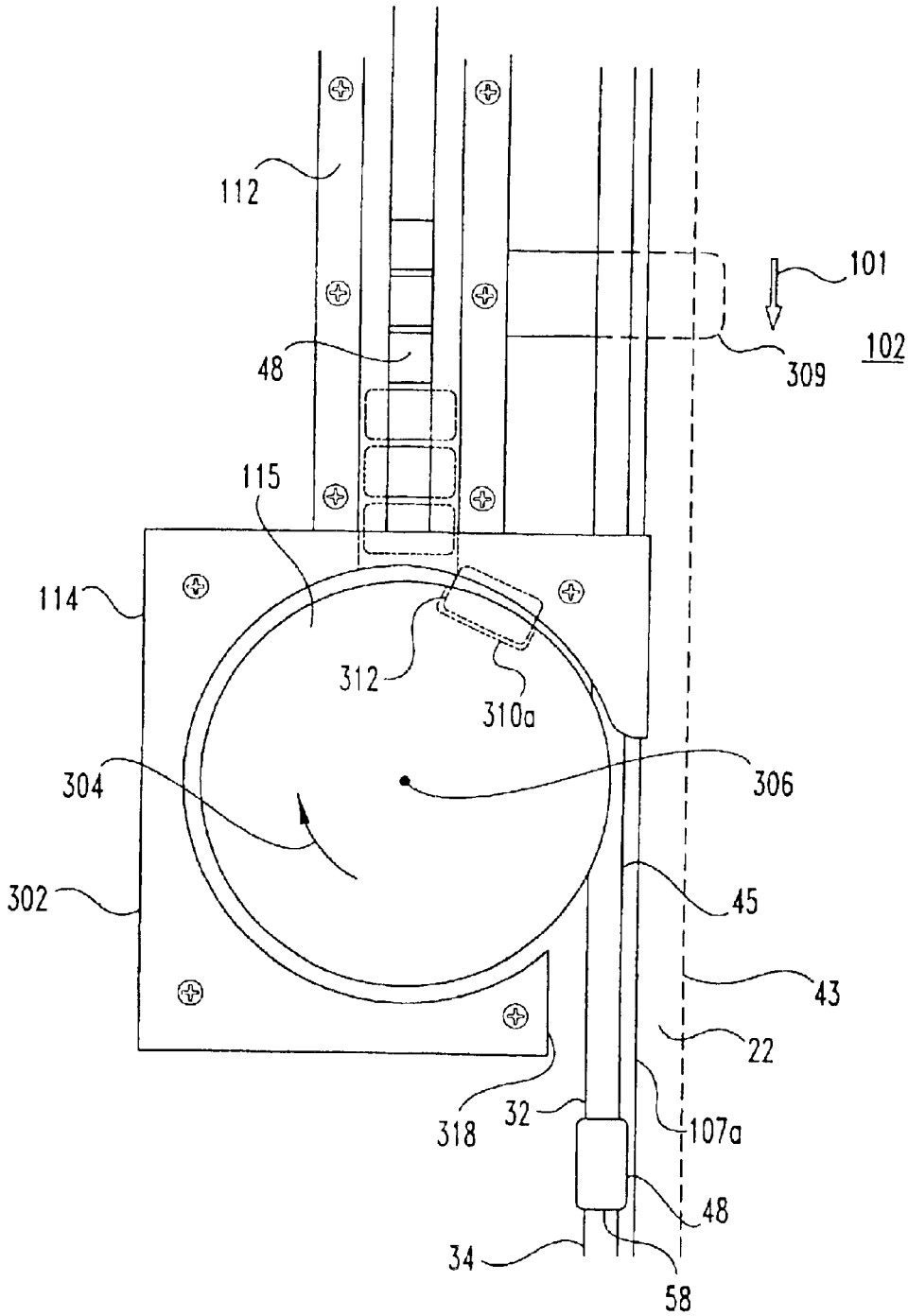
FIG. 4 shows a side elevational view of a slider application machine useful with the present invention.

FIG. 4 shows a side elevational view of a slider application machine useful with the present invention. Selector 115 includes within it four pockets 310. A first pocket 310*a* is shown after having accepted a slider 48 out of channel 112. As selector 115 rotates, pocket trailing edge 312 pushes slider 48 past a spreading ridge within block 302. The ridge contacts feet 54 and 56 of slider 48. The spreading ridge has a cross-sectional width that increases in the direction of rotation of selector 115. The height of the spreading ridge must be compatible with the length of separator 60 of slider 48, such that the two do not interfere during the spreading operation. As slider 48 is pushed along the spreading ridge, feet 54 and 56 are spread apart a sufficient distance to pass over closure elements 50 and 52 and shoulders 45 and 47. The present invention also contemplates those embodiments in which feet 54 and 56 also pass over edges 107*a* and 107*b*, respectively.

Web 102 traverses along filling tube 104, with strips 32 and 34 passing through a guiding slot within mounting block 302. The guide ensures proper orientation of the fastener strips 32 and 34 prior to placement of slider 48 on the strips. It is preferable that web 102 momentarily stop as selector 115 is rotated about 90 degrees. The positional movements of selector 115 and web 102 are synchronized such that a single slider 48 is placed on each container 20. In one embodiment of the present invention this synchronization is achieved by controlling both the rotational actuation of selector 115 and the flow of web 102. This control may be achieved by an analog controller that senses the stoppage of web 102, such as, by way of example only, a positional sensor on a gear train driving rotating sealing mechanism 108, or by an optical sensor that stops web 102 when a particular visual feature of web 102 passes in front of the sensor. As another example, synchronization may be achieved by a digital electronic controller that actuates selector 115 after determining from an encoder that a portion of web 102 equivalent to the width of container 20 as gone past machine 114 since the last slider 48 was placed over strips 32 and 34.

A pocket 310*a* with a slider 48 located therein is rotated to position slider 48 on web 102. Slider 48 moves over the spreading ridge and is spread open. Selector 115 then places slider 48 over fastener strips 32 and 34 at a first location before feet 54 and 56 have had sufficient time to return to their normal unspread configuration. Slider 48 returns to its unspread configuration under the influence of elastic forces within slider 48. Selector 115 stops rotation at a position with the pocket leading edge pulled away from contact with interlocking end 58 of slider 48. Web 102 is free to continue moving along filling tube 104 without interference from pocket 310*a*. Edge 318 of mounting block 302 is cut back a sufficient amount to permit slider 48 to freely pass thereby. By momentarily stopping web 102 as selector 115 is rotated, and also by moving the pocket leading edge away from contact with slider 48, it becomes unnecessary to coordinate the rotational speed of selector 115 with the linear speed of web 102. Web 102 is preferably static when slider 48 is applied. The present invention also contemplates those embodiments in which either or both selector 115 and web 102 move in a generally continuous fashion.

After placing a slider 48 over fastener strips 32 and 34 at the first location, slider 48 is then held in a static position by positioning arm 116 and slider receiver 118 as film web 102 continues to be pulled down filling tube 104. Arm 116 may be a pocket or hand located at the end of a pneumatic cylinder, the pocket or hand having a shape complementary to a portion of slider 48. Actuation of the cylinder places the pocket or hand near slider 48 and constrains slider 48 to a position. Receiver 118 may be a pocketed plate or a flat plate that helps constrain motion of slider 48 when arm 116 is actuated.

Arm 116 and receiver 118 thus position slider 48 such that it does not interfere with the formation of corner seals 40 and 42. Because of the orientation of interlocking end 58 to face in the direction of the flow of web 102, holding slider 48 stationary as web 102 continues to move ensures that interlocking strips 32 and 34 are interlocked downstream of each slider 48. For those embodiments of the present invention in which unlocking end 59 faces in the direction of the flow of web 102, the present invention contemplates moving slider 48 relative to web 102 such that strips 32 and 34 are interlocked downstream of each slider 48.

A portion of this interlocked length of strips 32 and 34 is presented between sealing horn 120 and sealing plate 122. A pneumatic cylinder places horn 120 at a second location along fastener strips 32 and 34 and free ends 107*a* and 107*b*, and against sealing plate 122. By means of heat, ultrasonic energy, or similar process horn 120 fuses the portions of fastener strips and sidewall between horn 120 and sealing plate 122 and simultaneously forms a corner seal 40 and endstop 36 of a first container 20, and a corner seal 42 and endstop 38 of an adjacent, second container 20. It is preferable that horn 120 and sealing plate 122 not alter shoulders 45 and 47, such that there remains shoulders 45 and 47 generally across the width of container 20 to restrain slider 48.

As the assembly of web 102, fastener strips 32 and 34, and slider 48 move down along filling tube 104, there is a second repositioning of slider 48. Slider 48 is positioned adjacent the second location fused by horn 120 and sealing plate 122 by positioning arm 124 which holds slider 48 stationary against slider receiver 126, in a manner similar to the positioning by arm 116 and receiver 118. It is preferable, but not necessary, that slider 48 be moved in a manner which interlocks strips 32 and 34 and positioned adjacent endstop 36 before endstop 36 is fully hardened. The softened area of strips 32 and 34 adjacent endstop 36 is thereby permanently deformed by slider 48. This movement of slider 48 into the previously fused area has been observed to reduce leakage from container 20. This permanently deformed area is docking station 39.

In some embodiments of the present invention, a tamper evident seal 127 is provided over guiding and tensioning rollers and into a second sealing mechanism 128. Mechanism 128 fuses a tamper evidence exterior seal 127 near free ends 107*a* and 107*b* of web 102, and over the exterior of slider 48 and fastener strips 32 and 34. In other embodiments of the present invention, a tamper evident interior seal 43 is located inside and between fastener strips 32 and 34, as indicated by dotted line 43 of FIG. 1. In other embodiments of the present invention it is not necessary to have a tamper evident seal.

As web 102 flows off of filling tube 104, a cutting and sealing mechanism 130 places a seal transversely across sidewalls 22 and 24. Having thus formed the first transverse seal of container 20, a product may be placed into the vertically extending filling tube 104 to thus fall within container 20. When container 20 is full and flows off of tube 104, sealing and cutting mechanism 130 forms the other transverse seal of container 20, and severs container 20 from web 102. The sealing and cutting mechanism 130 simultaneously forms the lower seal of the next container 20.

Figure 5:
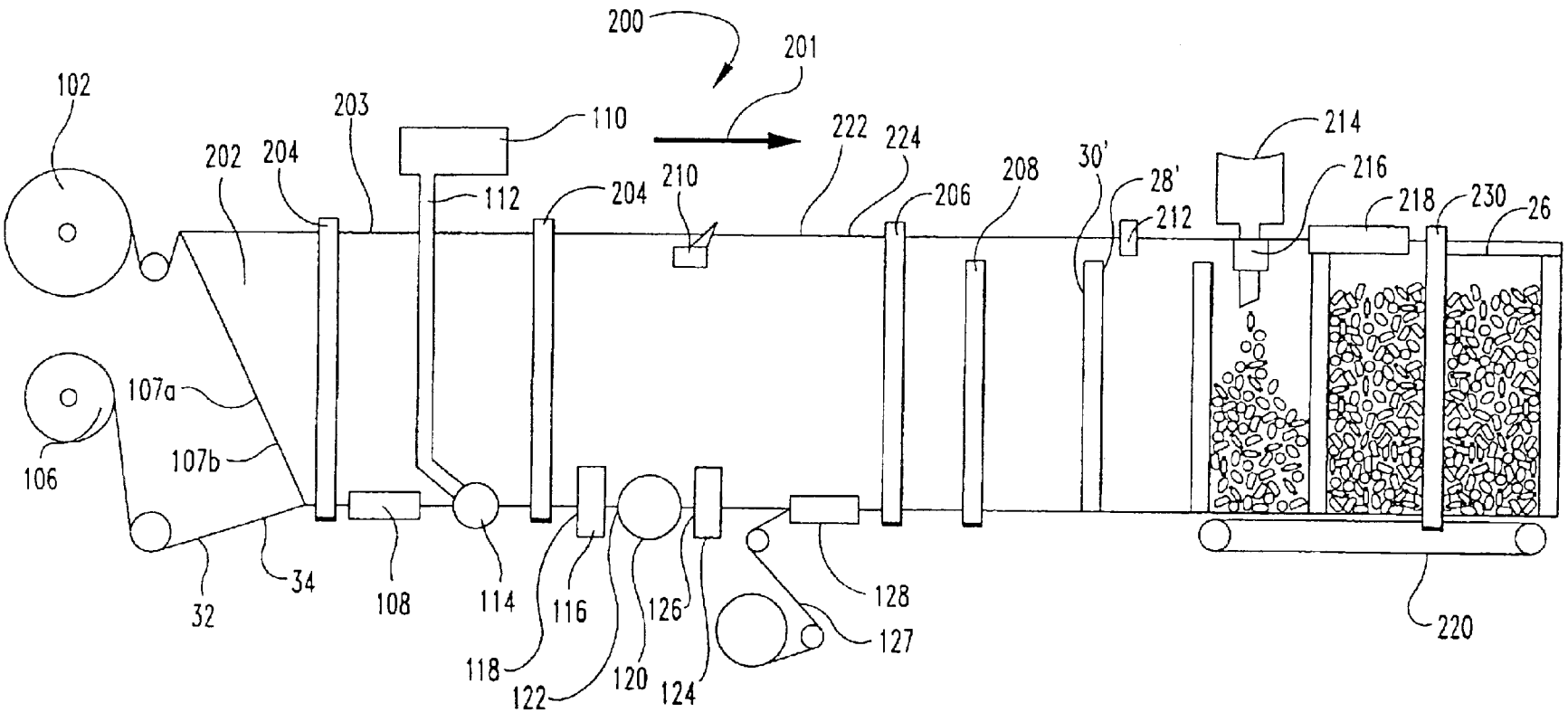
FIG. 5 is a schematic representation of a side view of apparatus 200, another embodiment of the present invention, for forming, filling, and sealing a container in a substantially horizontal manner.

FIG. 5 is a schematic representation of a side view of another embodiment of the present invention, apparatus 200 for forming, filling, and sealing a container such as container 20 in a substantially horizontal manner. The use of similar element numbers denotes elements substantially related to those already described.

A web 102 of film is fed over rollers and along a folding guide 202 in a horizontal direction as indicated by arrow 201. Guide 202 folds web 102 in half, with fold 203 preferably located above free edges 107*a* and 107*b*. It is also acceptable that fold 203 be located laterally to edges 107*a* and 107*b*, such that web 102 is generally placed in a horizontal plane. A supply of interlocking fastener strips 32 and 34 are guided into alignment with free edges 107*a* and 107*b*, and sealed thereto by sealer 108. Feeding mechanisms 204 generally guide and feed web 102. Rollers, belts, and similar devices are suitable as feeding mechanisms 204.

Sliders 48 are placed along fastener strips 32 and 34 by machine 114 in a manner previously described. Sliders 48 are positioned by arm 116 and receiver 118, a fused spot is created by horn 120 and sealing plate 122, and slider 48 is repositioned by arm 124 and receiver 126, all in a manner as previously described. A tamper evident seal 127, if desired, may be applied to container 20 by sealer 128 in a manner as previously described.

Prior to the formation of transverse seals, it is necessary to open the bottom edge 203 of container 20 for subsequent introduction of the product. A slitter 210 cuts through the fold. Slitter 210 is preferably a static mechanism that cuts bottom edge 203 as web 102 is pulled past slitter 210. Bottom edge 203 is cut into bottom free edges 222 and 224. Shortened rollers 212 continue to guide and feed web 102.

A pre-sealing mechanism 206 applies sufficient heat and pressure to web 102 to substantially flatten web 102 thereat, but not so much heat or pressure as to fuse the web sidewalls. This pre-sealing mechanism 206 substantially removes wrinkles that may exist in web 102. A sealing mechanism 208 creates partial transverse seals for container 20 at the flattened web position. Sealing mechanism 208 is preferably of a type that utilizes either heated metal bars or electrical impulse sealing bars. Sealing mechanism 208 creates partial transverse seals 28' and 30' that extend substantially but not completely across sidewalls 22 and 24. Mechanism 208 fuses a partial transverse seal from free edges 107*a* and 107*b* across sidewalls 22 and 24 to a point about one-half inch away from bottom free edges 222 and 224. By not forming transverse seals completely across sidewalls 22 and 24, there remains a portion along bottom free edges 222 and 224 which is useful for guiding and feeding web 102 and also for subsequent opening and filling of container 20.

After forming partial transverse seals, a product is placed within container 20. Container 20 is useful for containing products that are generally flowing in nature, such as small pieces of candy, granular products, and liquids. For example, with products of the type which have a flowing nature it is preferable that container 20 be oriented in a substantially vertical manner as it continues to move horizontally. FIG. 5 schematically depicts a apparatus 200 in which a flowing product such as candy is being gravity fed from a hopper 214 into a container 20. Container opening mechanism 216 spreads apart bottom free edges 222 and 224 as the motion of web 102 is momentarily halted. Mechanism 216 may use mechanical fingers to hold and spread apart edges 222 and 224. Alternatively, mechanism 216 may incorporate suction devices that grasp and spread apart edges 222 and 224.

After introduction of the product into container 20, free edges 222 and 224 are fused together by bottom sealing mechanism 218. Mechanism 218 places a wide sealing area on container 20, such that a seal is formed that overlaps with partial transverse side seals 28' and 30'. In this way, the approximate one-half inch not sealed by sealing mechanism 208 is instead sealed by mechanism 218. Following the placement of a bottom seal, a cutting mechanism 230 severs adjacent containers 20 through the full transverse side seal 28 and 30. It may also be necessary to trim some of the sealed bottom edge of container 20.

Figure 6:
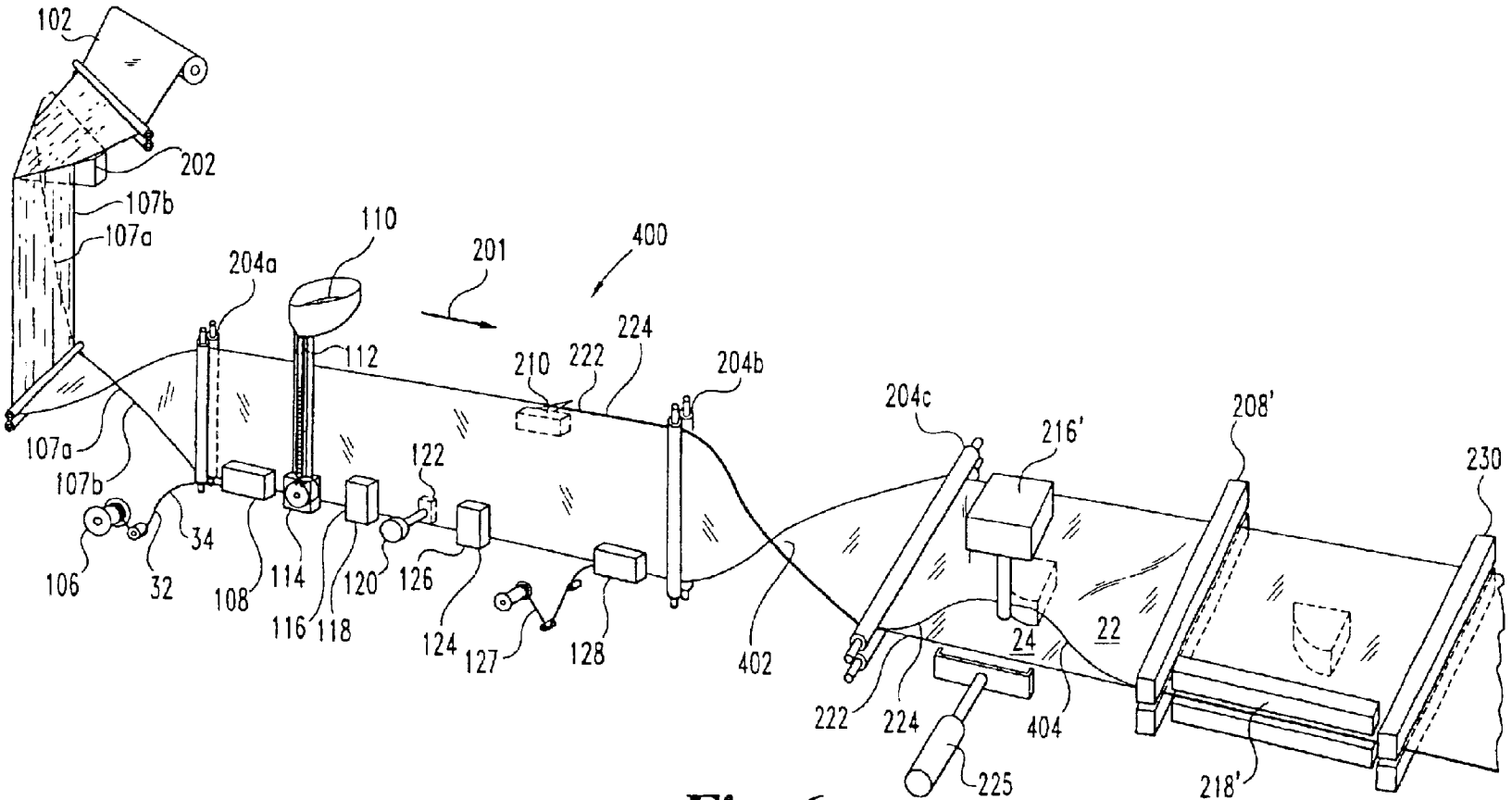
FIG. 6 is a perspective schematic of apparatus 400, another embodiment of the present invention, for forming, filling, and sealing a container in a substantially horizontal manner.

Container 20 is also useful for larger products with a well defined shape, such as cheese and large candy bars. Web 102 may require reorientation based upon the type of product to be inserted within container 20. For placement within container 20 of those products that are large and have a definite shape it is preferable that web 102 be in a substantially horizontal plane, such that free edges 222 and 224 are at about the same elevation as fastening strips 32 and 34. FIG. 6 is a perspective schematic of apparatus 400, one embodiment of the present invention, for forming, filling, and sealing a container in a substantially horizontal manner. Apparatus 400 begins in a manner similar to that of apparatus 200. Web 102 is fed by rollers 204*a* and 204*b* along a substantially horizontal path, preferably in a vertical orientation. Alternatively, web 102 may be pulled in a horizontally planar orientation. Fastener strips 32 and 34 are attached and sealed to web 102, a slider 48 is placed on the strips by machine 114, and a tamper evident seal, if desired, is attached.

In those embodiments in which web 102 is pulled by rollers 204 in a vertical orientation, there is a subsequent reorientation of web 102 to a horizontal plane. As web 102 passes through second roller set 204*b* there is a twist 402 of 90 degrees before web 102 passes through third set of rollers 204*c*. It is preferable to support the underside of the horizontal portion of web 102 so that the product placed between the sidewalls is supported. This support may be in the form of a belt or roller conveyor, for example.

A spreading mechanism 216' holds free edge 224 and lifts it vertically, creating opening 404 within web 102. In some embodiments it may be helpful to permit that portion of web 102 downstream of mechanism 216' to return toward mechanism 216', such that the lifting of free edge 224 does not unduly stress sidewall 22. A product is placed within sidewalls 22 and 24 of web 102 by placement mechanism 225 and free edge 224 is brought back into contact with edge 222. Transverse side seals 28 and 30 across web 102 are formed by sealing machine 208'. Sealing machine 208' places a full transverse seal across web 102. Sealing machine 208' must also separate sufficiently such that the product within container 20 may pass therebetween. Free edges 224 and 222 are then fused together by heat, ultrasonic energy, or other method by bottom sealer 218'. Bottom sealer 218' applies a slightly narrower seal than bottom sealer 218, because of the full transverse seal applied by sealing mechanism 208'. A cutting mechanism 230 then severs container 20 from web 102 through the transverse seals.

The present invention also incorporates methods and apparatus which can improve the operation of apparatus 100, 200, and 400 described herein for forming, filling, and sealing a flexible recloseable container. Further, the methods and apparatus to be described can also improve the operation of other methods and apparatus for forming, filling, and sealing a flexible recloseable container, and also for forming a flexible recloseable container, as those of ordinary skill in the art will readily appreciate. The use of the same element numbers refers to elements the same as previously described, but with any adaptations and changes being noted. Further, the present invention includes methods and apparatus for manufacturing flexible, recloseable containers that do not contain a product and which are sold in an empty state to a consumer.

FIGS. 7–35 show various aspects of the embodiments of the present invention relating to interlocked fastener strips with sliders. One embodiment relates to an apparatus comprising a pair of interlocked fastener strips of a length sufficient to be attached to a plurality of flexible recloseable containers such as, by way of example, apparatus 20. This pair of fastener strips has applied to it in straddling relationship a plurality of sliders for locking and unlocking the closure elements of the fastener strips. In various alternate embodiments to be described, the pair of fastener strips and plurality of sliders may also include a variety of other features, such as a plurality of docking stations, endstops, position marks, or a preferably continuous tamper evident seal.

The sliders and other features are preferably applied to the pair of fastener strips prior to attaching the fastener strips to film web 102. The apparatus thus described may be suitably packaged, such as being wound on a supply roll, or used directly without packaging, and used subsequently in a forming, filling, and sealing (FFS) process, or in a process to manufacture empty containers. The use of this novel apparatus is believed to simplify, make more reliable, and make less costly those forming, filling, and sealing applications which include a flexible recloseable container with a slider. For example, an existing machine for forming, filling, and sealing a flexible recloseable container without sliders can use the pair of fastener strips with pre-applied sliders as described. With only slight modifications, such as for accommodating the thickness of the slider through the material path, an existing FFS machine utilizing the present invention can produce a recloseable container that incorporates a slider. In contrast, the adaptation of an existing FFS machine to apply sliders after the profiles have been attached to the web of plastic film may require repositioning of several process stations of the FFS machine and the introduction of new process stations, along with adapting the material path to accommodate the thickness of the slider. On newly designed FFS it is believed that the use of fastener profiles with a plurality of sliders applied thereto prior to adhering the profiles to the web results in an FFS machine that is simpler and therefore cheaper, more reliable, and less expensive to operate. Further, since the application of the slider to the fastener profiles is one of the more complicated and troublesome aspects of forming, filling, and sealing, the separation of slider application away from the forming, filling, and sealing process permits the slider to be applied more reliably and repeatably since portions of the process need not be compromised for the forming, filling, and sealing processes.

Figure 7:
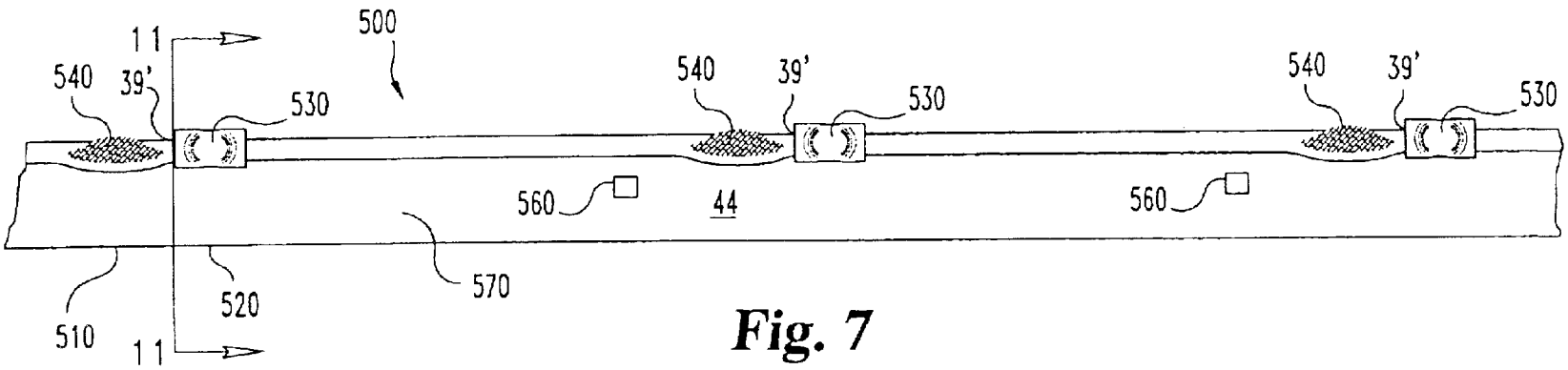
FIG. 7 is a side elevational view of a portion of an apparatus according to one embodiment of the present invention.
Figure 11:
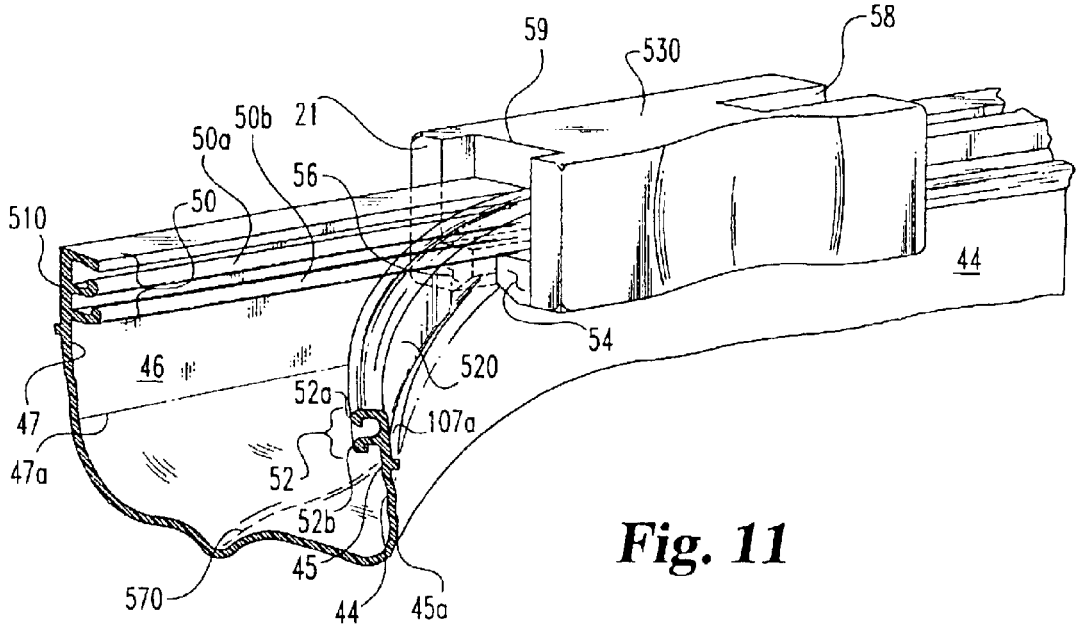
FIG. 11 is a perspective view of the apparatus of FIG. 7 as taken along 11—11 of FIG. 7.

FIG. 7 is a side view of one embodiment of the present invention. FIG. 7 shows a portion of apparatus 500 which comprises a first fastener strip 510 which is preferably substantially interlocked along its length with a second fastener strip 520. In one embodiment, fastener strips 510 and 520 are interlocked by a pair of hook-shaped closure elements 50 and 52, as best seen in FIG. 11. A plurality of sliders 530 are coupled to first fastener strip 510 and second fastener strip 520 in straddling relation thereto. A plurality of fused endstops 540 are placed along the length of fastener strips 510 and 520. Endstops 540 and sliders 530 are arranged along fastener strips 510 and 520 in an alternating manner, the sliding movement of any individual slider 530 being limited by adjacent endstops 540. This alternating pattern of endstops and sliders maintains a reasonably even distribution of sliders along the length of apparatus 500 as apparatus 500 is subsequently packaged and handled, and/or attached to a web of plastic film. The plurality of endstops thus prevents sliders from migrating in position along the length of apparatus 500, with the subsequent need for gross repositioning to ensure placement of a single slider on each container. However, the present invention also contemplates those embodiments of a slider on interlocked fastener strips in which endstops have not been placed on the interlocked pair of fastener strips. Also, the present invention also contemplates those embodiments in which the fastener strips 510 and 520 are not substantially interlocked, but are interlocked in the vicinity of slider 530 or coupled together at endstops 540.

Apparatus 500 also includes a plurality of docking stations 39' as previously described created along the length of fastener strips 510 and 520, docking stations 39' being substantially the same as docking station 39 described herein, except that docking station 39' is created on the fastener strips before the strips are attached to the sidewalls of the container. Docking station 39' is created by positioning slider 530 into the heat affected zone created when fusing a portion of fastener strips 510 and 520 to create fused endstop 540. Moving the closure element separating portion of slider 530 into the heat affected zone proximate to fused endstop causes the heat affected material of the fastener strips to set in a position that reduces mechanical pressure exerted on the separating portion of slider 530 by fastener 510 and 520

In one embodiment, apparatus 500 preferably includes a plurality of position marks 560 arranged along the length of at least one of fastener strips 510 and 520. Position marks 560 are reference marks which cooperate with a sensor and controller by which the repetitive features of apparatus 500, such as endstops 540, sliders 530, docking stations 39', or other repetitive features may be spaced apart along the length of the fastener strips in a spacing corresponding to the length of the recloseable container. Also, position marks 560 cooperate with a sensor and controller in a process for forming, filling, and sealing to establish the size of the final recloseable container, as will be described later. The present invention contemplates a variety of different types of position marks 560, depending upon the type of sensor chosen. For example, position marks 560 may be substantially opaque for cooperating with an optical sensor, or may be substantially transparent on a substantially opaque background for cooperating with an optical sensor, or could be electrically conductive for cooperating with an electrical continuity sensor.

Figure 8:
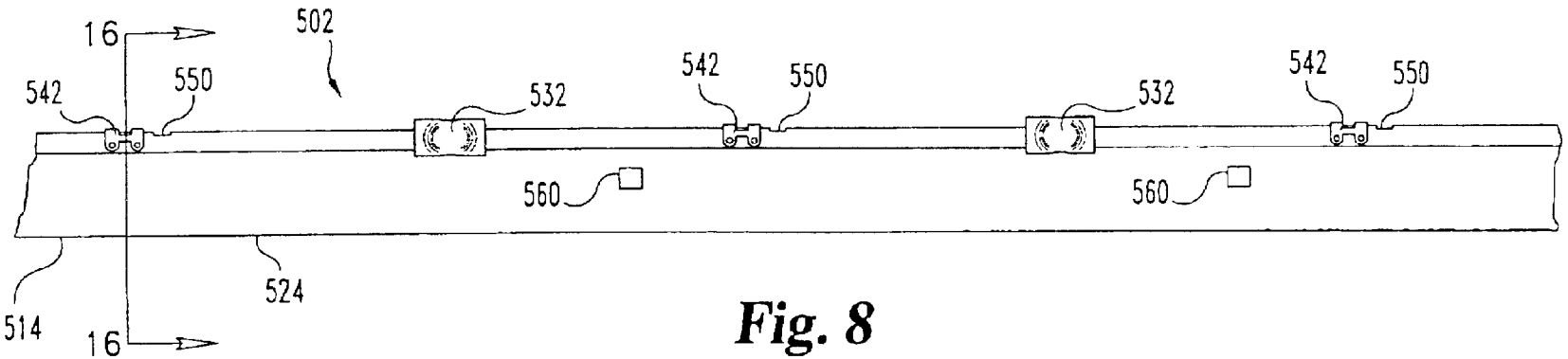
FIG. 8 is a side elevational view of a portion of an apparatus according to another embodiment of the present invention.
Figure 16:
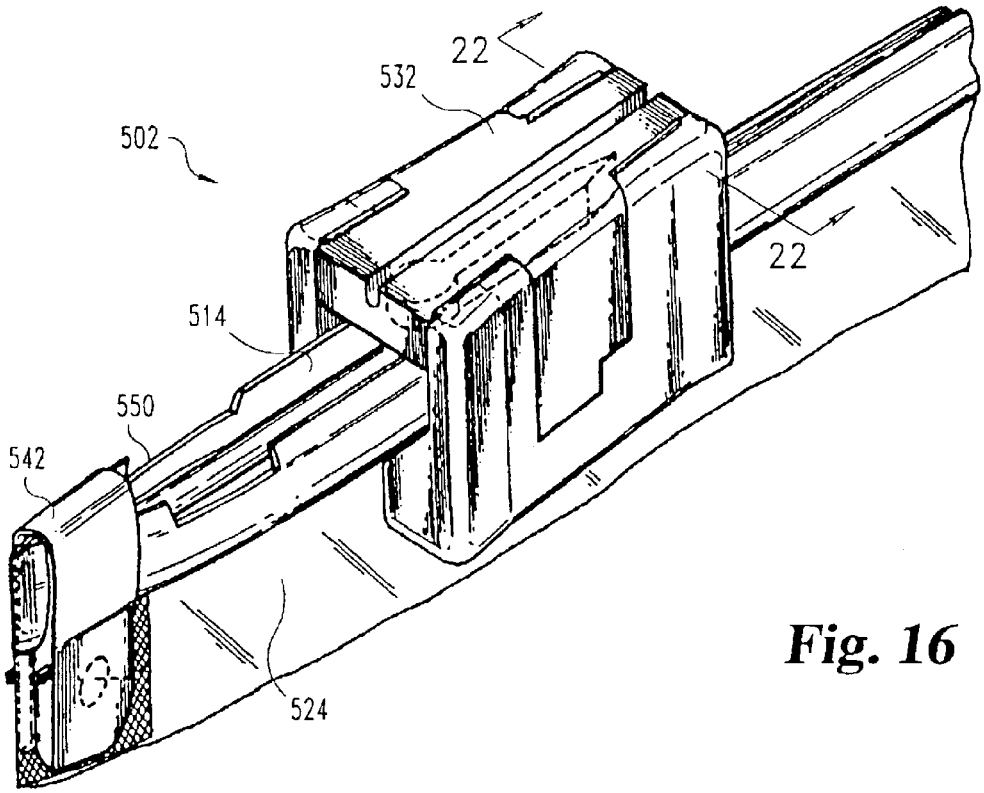
FIG. 16 is a perspective view of the apparatus of FIG. 8 as taken along lines 16—16 of FIG. 8
Figure 22:
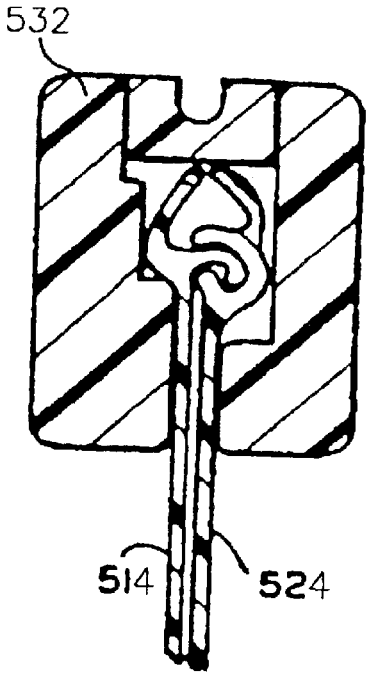
FIG. 22 is a cut away of the apparatus of FIG. 16 as taken along line 22—22 of FIG. 16.

FIG. 8 is a side view of another embodiment of the present invention. FIG. 8 shows a portion of an apparatus 502 which comprises a first fastener strip 514 which is substantially interlocked along its length with the second fastener strip 524. A plurality of sliders 532 are coupled to fastener strips 514 and 524 in straddling relation thereto. A plurality of mechanically joined endstops 542 are placed along the length of fastener strips 514 and 524. Endstops 542 are placed along fastener strips 514 and 524 by clamping a portion of the interlocked pair of fastener strips with a clamp as described in U.S. Pat. No. 5,067,208. Preferably, a plurality of docking stations 550 are created on the pair of interlockable fastener strips 514 and 524 by cutting and removing a notch of fastener strip material from a lengthwise portion of fastener strips 515 and 524. The notch of docking station 550 relieves pressure exerted on the closure element spreading portion of slider 532 by the portion of fastener strips 514 and 524 that extends outwardly from their respective closure elements. The force required to move slider 530 along fastener strips 514 and 524 is thus lessened when the slider is placed within docking station 550. Another example of a notched docking station 550 is also described in U.S. Pat. No. 5,067,208. A perspective view of a portion of apparatus 502 is shown in FIG. 16. FIG. 16 is a perspective view of a portion of the apparatus of FIG. 8, as taken along line 16—16 of FIG. 8, with slider 532 moved slightly toward a line 16—16, and with endstop 542 severed approximately midway through. The closure elements of fastener strips 514 and 524 are best seen in FIG. 22. FIG. 22 is a sectional view of the apparatus of FIG. 16 as taken along line 22—22 of FIG. 16. Fastener strips 514 and 524 and endstop 542 are also described in U.S. Pat. No. 5,067,208.

Although what has been described is creating a docking station by cutting a plurality of notches from each of the fastener strips, the present invention also contemplates creating a docking station by cutting a plurality of notches from only one of the fastener strips. The cutting and removal of a notch from a single fastener strip also relieves pressure exerted on the closure element spreading portion of the slider, and thus lessens the force required to move the slider when the slider is placed within docking station.

Figure 9:
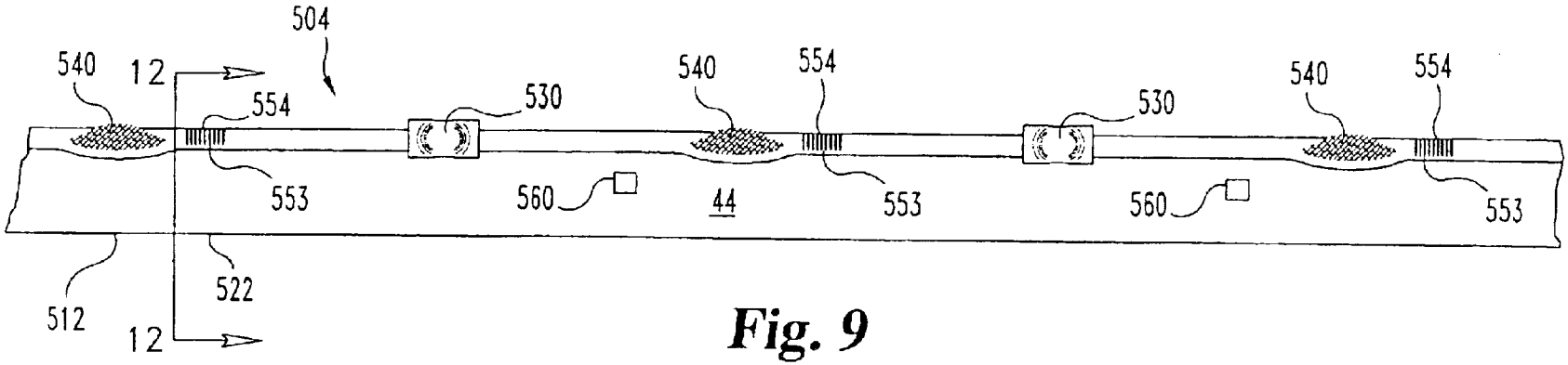
FIG. 9 is a side elevational view of a portion of an apparatus according to another embodiment of the present invention.
Figure 12:
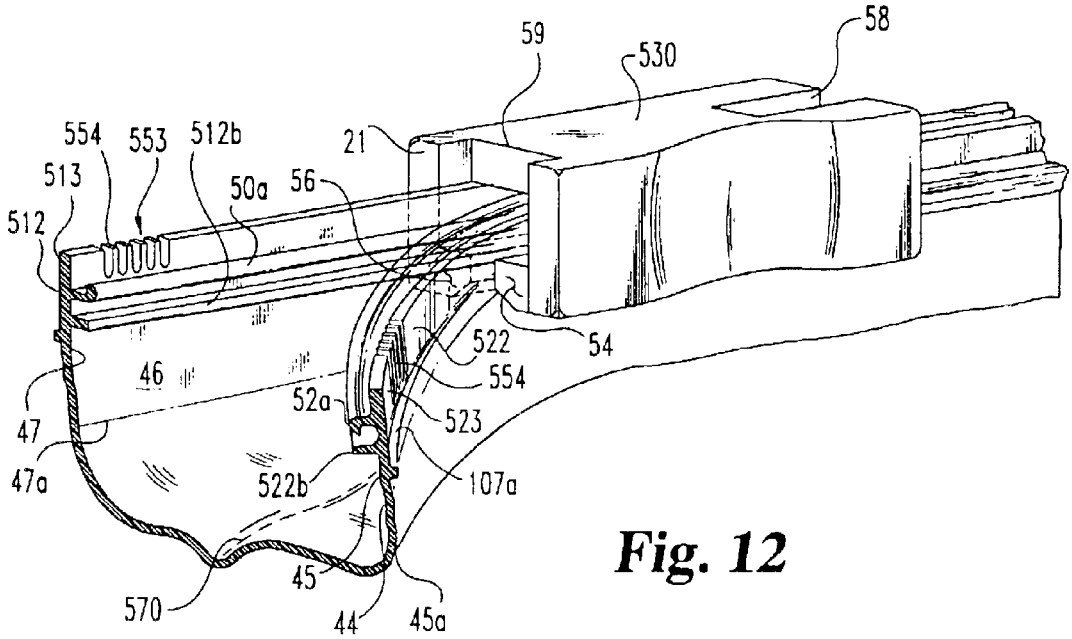
FIG. 12 is a perspective view of the apparatus of FIG. 9 as taken along line 12—12 of FIG. 9.

FIG. 9 is a side view of another embodiment of the present invention. FIG. 9 shows a portion of apparatus 504 which comprises a first fastener strip 512 which is substantially interlocked along its length with the second fastener strip 522. A plurality of sliders 530 are coupled with fastener strips 512 and 522 in straddling relation thereto. As best seen in FIG. 12, fastener strips 512 and 522 each include a single pair of closure elements 50*a* and 52*a*, respectively, and a pair of separating fingers 512*b* and 522*b*, respectively. Separating fingers 512*b* and 522*b* assist in maintaining a spaced apart relationship of fastener strips 512 and 522 when interlocked and thereby improve the ability of fastener strips 512 and 522 to retain a slider in straddling relationship. Returning to FIG. 9, a plurality of fused endstops 540 are placed along the length of fastener strips 510 and 520 in an alternating manner with sliders 530.

Proximate to each endstop 540 is a docking station 554. One embodiment of docking station 554 comprises a plurality of slits 553 which extend through a portion of fastener strip 512 and fastener strip 522. As best seen in FIG. 12, slits 553 extend through upwardly projecting portions 513 and 523 of fastener strips 512 and 522, respectively. Upwardly projecting portion 513 extends outwardly from closure element 50*a*, and upwardly projecting portion 523 extends outwardly from closure element 52*a*. When closure elements 50*a* and 52*a* are locked together, portion 513 generally faces portion 523. Slits 553 extend through portions 513 and 523, but preferably do not extend through closure elements 50*a* or 52*a*. Slits 553 are preferably cuts made through the lengthwise, outwardly extending portion of the fastener strips, and are preferably made without removal of material from the fastener strips. In a most preferred embodiment, docking station 554 comprises a plurality of slits 553, individually spaced apart by about 0.1 inches and extending over a span of fastener strip of about one-forth to one-half of the length of the slider. The plurality of closely spaced slits locally weaken the fastener strip, such that the slit portion is more easily deformed by the slider, thereby reducing the mechanical pressure exerted by the fastener strip on the separating portion of the slider. Although a specific preferred embodiment has been described, those of ordinary skill in the art will recognize other spacings and spans of slits 553 which locally weaken the fastener strips so as to produce suitable docking station characteristics. Further, the present invention also contemplates those embodiments which incorporate a docking station with a single slit 553.

Although what has been described is creating a docking station by cutting one or more slits from each of the fastener strips, the present invention also contemplates creating a docking station by cutting one or more slits from only one of the fastener strips. The cutting of one or more slits from a single fastener strip also relieves pressure exerted on the closure element spreading portion of the slider, and thus lessens the force required to move the slider when the slider is placed within docking station.

Figure 10:
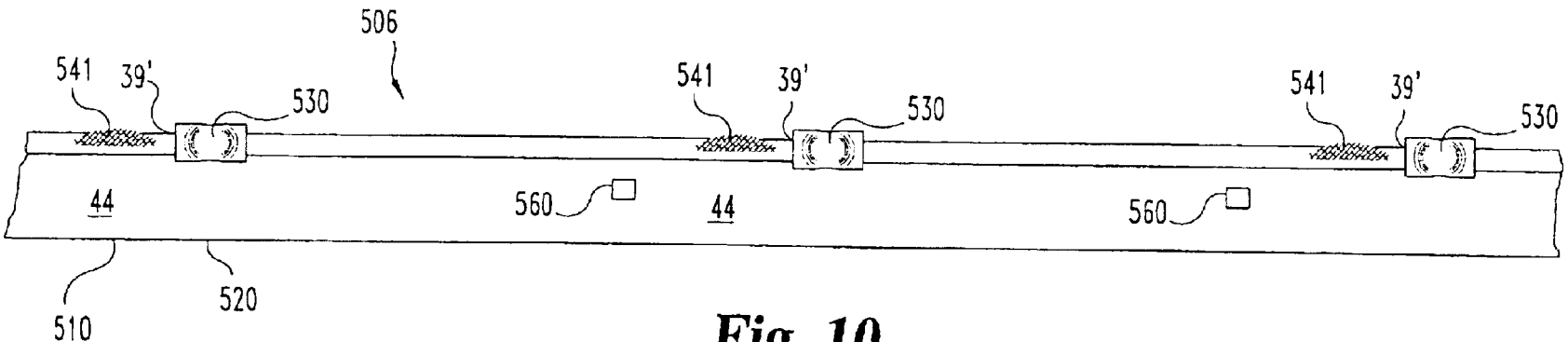
FIG. 10 is a side elevational view of a portion of an apparatus according to another embodiment of the present invention.

FIG. 10 is a side view of another embodiment of the present invention. FIG. 10 shows a portion of an apparatus 506 which comprises a first fastener strip 510 which is substantially interlocked along its length with a second fastener strip 520. A plurality of sliders 530 are coupled to first fastener strip 510 and second fastener strip 520 in straddling relation thereto. A plurality of fused endstops 541 are positioned along the length of fastener strips 510 and 520. Fused endstops 541 are generally similar to fused endstops 540, except that endstops 541 extend only through the uppermost region of the closure elements. For example, endstops 541 may fuse together only the uppermost closure elements and material above them, and leave the lowermost closure elements intact. The downward extent of the fused area in endstop 541 is purposefully less than the downward extent of endstop 540 so as to minimize the heat affected zone within side flanges 44 and 46. Side flanges 44 and 46 are provided for later attachment of a web of flexible film so as to produce a flexible recloseable container, as described above. Endstop 541 thus helps maintain the entire width of flanges 44 and 46 suitable for attachment to a web of film. Those embodiments of the present invention incorporating endstop 541 may require subsequent fusing of the entire width of the closure elements of the fastener strips after attachment of the fastener strips to the web of flexible film to form an adequate transverse seal of the container.

FIG. 11 is a perspective view of a portion of the apparatus of FIG. 7, as taken along line 11—11 of FIG. 7, with slider 530 moved slightly away from line 11—11 and with profiles 510 and 520 separated. Fastener profiles 510 and 520 are substantially identical to fastener profiles 34 and 32 (as shown in FIG. 2), respectively, except that fastener profiles 510 and 520 are of sufficient length to make a plurality of flexible recloseable containers such as container 20, and have not been attached to a web of flexible plastic film. Also, tamper evident seal 570 is preferably continuous along the length of fastener profiles 510 and 520. Slider 530 is substantially identical to slider 48, except that slider 530 is placed on a pair of fastener strips that have not been attached to the sidewalls of a container.

FIG. 12 is a perspective view of a portion of the apparatus of FIG. 9, as taken along line 12—12 of FIG. 9, with slider 530 moved slightly away from line 12—12 and with profiles 512 and 522 separated. Fastener strips 512 and 522 are similar to fastener strips 510 and 520, except as herein described. Fastener strip 512 includes a single closure element 50*a* which is adapted and configured to repeatedly lock and unlock with a single closure element 52*a* of fastener strip 522. Located inboard from closure element 50*a* is a separating finger or spacing member 512*b* which, when fastener strips 512 and 522 are interlocked, abuts against the inner surface of fastener strip 522 so as to maintain a separating distance between the inner surfaces of fastener strips 512 and 522. Similarly, separating finger or spacing member 522*b* maintains a separating distance between fastener strips 512 and 522 by abutting against the inner surface of fastener strip 512 when fastener 512 and 522 are interlocked.

Figure 24:
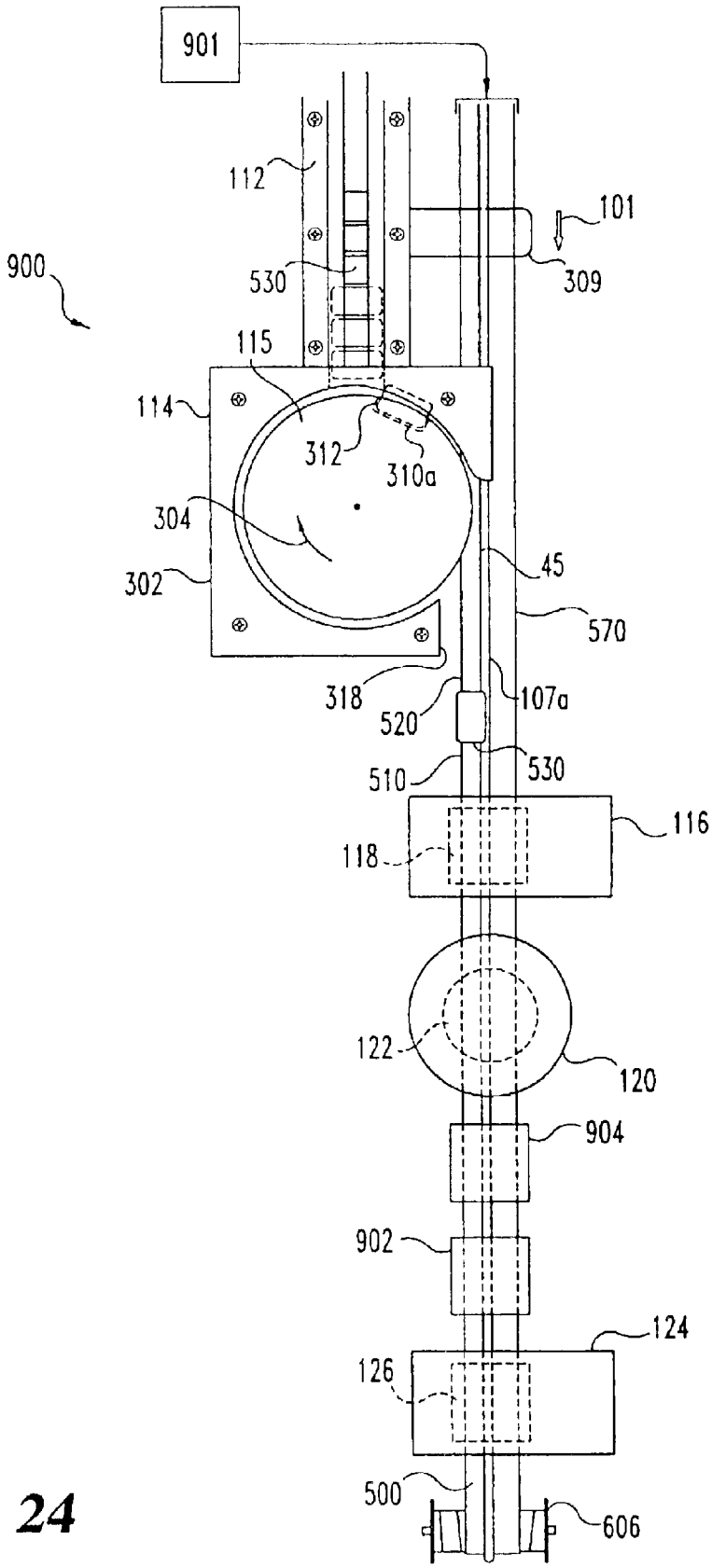
FIG. 24 is a schematic representation of apparatus 900 according to one embodiment of the present invention.

FIG. 24 is a schematic side view of an apparatus 900 for fabricating apparatus 500 (see FIG. 7). A supply of fastener strips 510 and 520 that are preferably interlocked is provided, in one embodiment, to a slider application machine 114 from source 901 which may be, for example, an extruding machine or a supply of fastener strips 510 and 520 packaged such as on a spool. U.S. Pat. No. 5,956,815, naming inventors O'Connor and Burke and which issued Sep. 28, 1999, describes an apparatus used to extrude fastener strips and is incorporated herein by reference. A vibrating hopper or bowl 110 (not shown in FIG. 24 for sake of clarity, but shown in FIGS. 3, 5, 6) provides a supply of sliders 530 along a channel 112 to slider application machine 114. A stationary probe 309 spreads apart fastener strips 510 and 520, also in a manner previously described.

As fastener strips 510 and 520 progress past slider application machine 114 in direction 101, a plurality of sliders 530 are coupled to fastener strips 510 and 520 in a manner as previously described. Interlocked profiles 510 and 520 then progress past and between a positioning arm 116 and slider receiver 118 for repositioning sliders 530. In a preferred embodiment, fastener profiles 510 and 520 then progress past and between a sealing horn 120 and sealing plate 122 which cooperate to form a plurality of endstops 540 (FIG. 9) or 541 (FIG. 10). For those embodiments of the present invention incorporating clamped endstops, a clamping mechanism 904 is shown schematically in FIG. 24. Clamping mechanism 904, for example, includes the mechanisms to attach a mechanical clamp 542 (FIG. 8), as are known to those of ordinary skill in the art. In other embodiments, there is a second repositioning of sliders 530 by positioning arm 124 and slider receiver 126 so as to form a docking station 39'. In some embodiments, a docking station such as docking station 550 (FIG. 20) or 554 (FIGS. 9 and 12) is incorporated by a slitting mechanism 902 shown schematically in FIG. 24. Slitting mechanism 902 incorporates either a notched docking station 550 or a docking station 554 preferably comprising a plurality of slits 553, as best seen in FIG. 12. In some embodiments of the present invention, slitting mechanism 902 incorporates only a single slit 553 in the fastener strips. The resultant apparatus 500 is then wound on a spool to become a supply 606 for a forming, filling, and sealing machine, or a supply for a machine for manufacturing empty containers. Although what has been shown and described for apparatus 900 is a particular arrangement of devices for repositioning, sealing, slitting, and other functions, those of ordinary skill in the art will recognize different orders in which the same functions may be performed as is contemplated by the present invention.

Apparatus 900 (FIG. 24) can be either intermittent or continuous in operation when using a supply 901 of fastener strips 510 and 520. For example, the supply 901 of fastener strips can be intermittent, with the supply of fastener strips stopping for various operations such as forming of endstops, application of sliders, repositioning of sliders, incorporation of mechanical clamps, slitting the fastener strips, and other operations. Also, the supply 901 of fastener strips can be continuous, with the supply of fastener strips not stopping for various operations such as forming an endstop, application of sliders, repositioning of sliders, incorporation of mechanical clamps, slitting the fastener strips, and other operations, such that the apparatus utilized for performing these operations include movement along the path of the fastener strips so that the fastener strips do not need to stop.

It is understood that the present invention is not limited to the fastener strips, sliders, endstops, docking stations, or position marks illustrated herein, and that other fastener strips, sliders, endstops, docking stations, and position marks may be utilized in connection with the present invention. Various examples of these features are presented herein, but those of ordinary skill in the art will recognize other configurations for these features applicable to the present invention.

Figure 13:
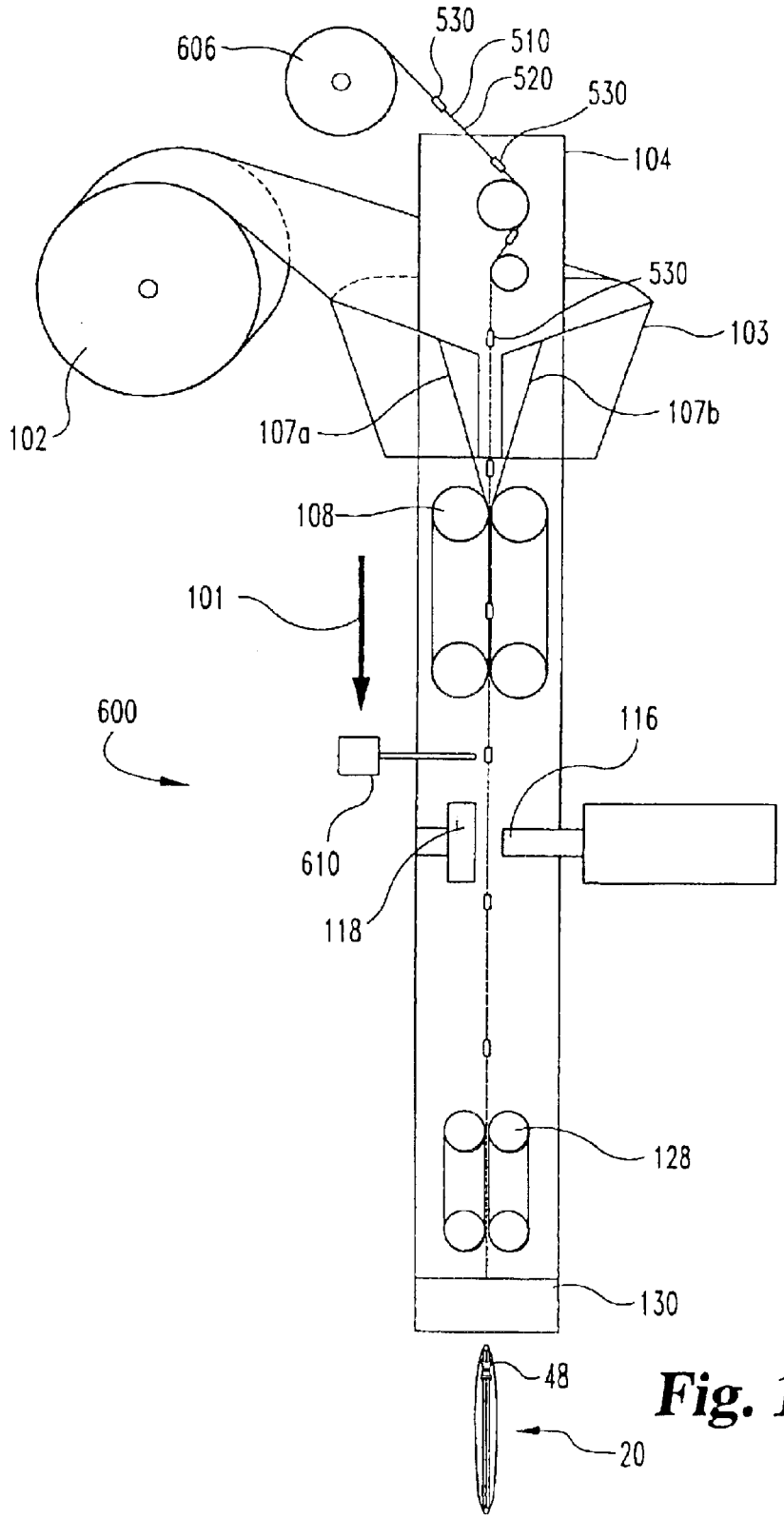
FIG. 13 is a schematic representation of apparatus 600, one embodiment of the present invention, for forming, filling, and sealing a container in a substantially vertical manner.

FIG. 13 is a schematic representation of apparatus 600, another embodiment of the present invention for forming, filling, and sealing a flexible recloseable container in a generally vertical orientation. Apparatus 600 is substantially similar to apparatus 100, except as described herein. Apparatus 600 includes the various driving mechanisms necessary for feeding a web 102 of plastic film and attaching to it a pair of interlockable fastener strips to which are attached a plurality of sliders. In one embodiment, a supply of flexible plastic webbing 102 is attached to a supply 606 of fastener profiles 510 and 520 to which a plurality of sliders 530 are coupled. A sealing mechanism 108, as previously described and preferably utilizing heated metal bars, electrical impulse ceiling bars, ultrasonics, or hot air, forms a continuous seal from inner flanges 44 and 46 of fastener strips 520 and 510, respectively, to the side walls of the flexible recloseable container. The various guiding mechanisms and driving mechanisms of apparatus 600 in contact with the fastener strips from supply 606 are adapted to accommodate the size and location of sliders 530. Because apparatus 600 is provided with a supply 606 of fastener strips with sliders already attached, apparatus 600 does not need the vibrating hopper or bowl 110, channel 112, or slider application machine 114 of apparatus 100.

In a preferred embodiment, apparatus 600 includes a sensor 610 for detecting a target on fastener strip 510 or 520, such as position mark 560 (FIGS. 7–10). Sensor 610 may include any of a variety of sensors suitable for detecting a target as are known to those of ordinary skill in the art, including by way of example, optical sensors that sense light reflected from position mark 560, optical sensors that sense an interruption of light when a light beam is broken by position mark 560, and other optical sensors known to those of ordinary skill in the art. In other embodiments, sensor 610 could include, for example, an electrical continuity sensor that senses a change in conductivity of the fastener profile when position mark 560 passes underneath. For those embodiments of the present invention including a notched docking station 550, sensor 610 could include a position sensor for sensing the indentation of the notch.

Upon sensing a position mark 560, a controller (not shown) controls apparatus 600 to perform the various container related processes, such as one or more repositionings of the slider, detection of the presence of the slider, forming seals, and cutting the bag in spatial relationship to the position marks. For example, the slider may be placed at a position along the fastener strip in reference to the position mark. Having so placed the slider, the other features of the recloseable container, such as the transverse seals or additional endstop sealing for those interlocked strips incorporating fused endstops 541, are also incorporated on the webbing in spatial relationship to the position marks. However, the present invention also contemplates interlocking fastener strips without position marks, in which case positioning of sliders, creation of docking stations, forming of transverse seals, and other spatially-related tasks are performed, for example, by measurement of the length of the interlocked strips and/or webbing of film.

For those fastener profiles that incorporate a docking station 550 (FIG. 8) formed adjacent a fused endstop 540 (FIG. 9), apparatus 600 may be further simplified relative to apparatus 100 (FIG. 3) by removing sealing horn 120 and sealing plate 122, as well as second positioning arm 124 and slider receiver 126. As yet another simplification, the supply of tamper evident seal 127 (FIG. 3) and second sealing mechanism 128 of apparatus 100 may also be eliminated for those embodiments where the fastener profiles from supply 606 already incorporate a tamper evident seal 570 (FIG. 12). The controller for apparatus 600 (not shown) controls sealing and cutting mechanism 130 so as to form the transverse seal of the container and to transversely cut adjacent containers generally through the endstop.

Figure 14:
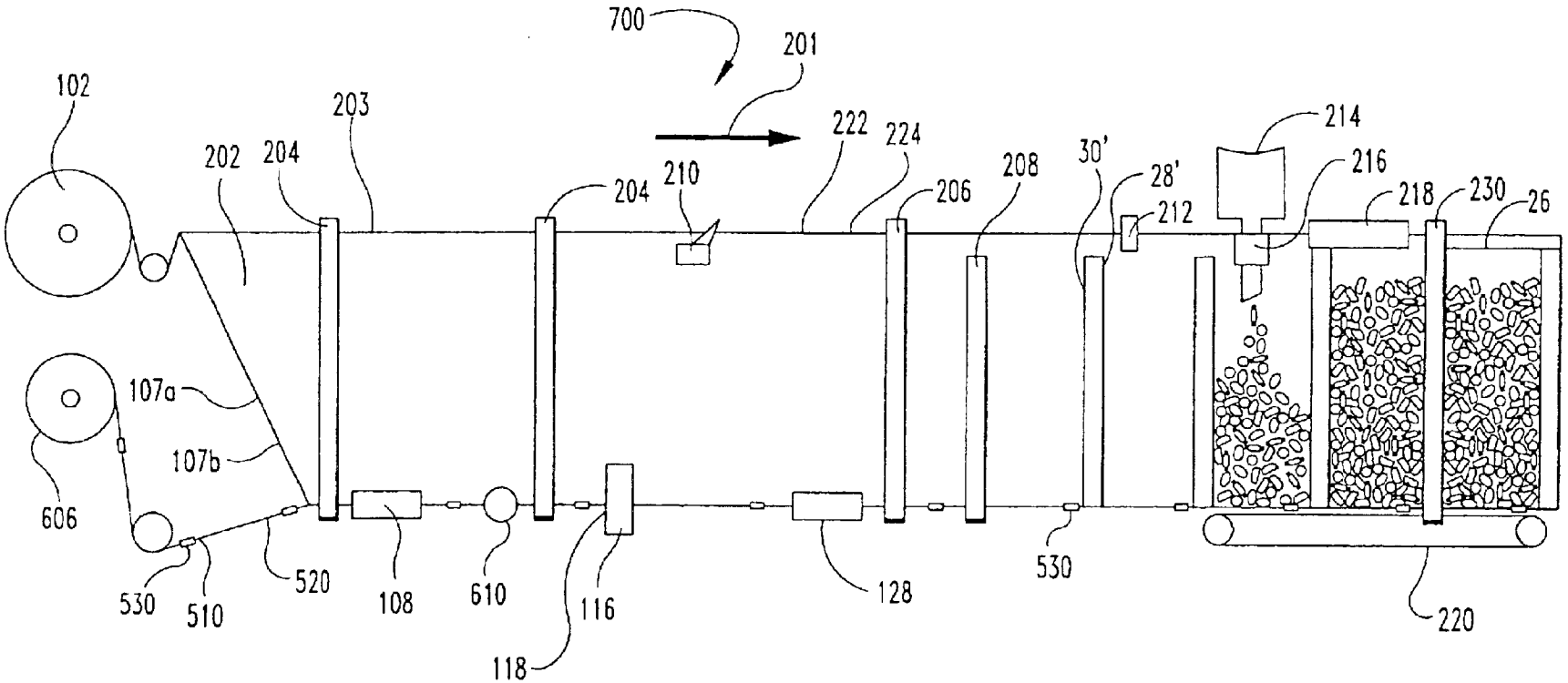
FIG. 14 is a schematic representation of a side view of apparatus 700, another embodiment of the present invention, for forming, filling, and sealing a container in a substantially horizontal manner.

FIG. 14 is a schematic representation of a side view of another embodiment of the present invention, apparatus 700 for forming, filling, and sealing a container in a substantially horizontal manner. Apparatus 700 is substantially similar to apparatus 200 (FIG. 5), except as adapted and described herein. Sealing mechanism 108 is preferably of a type that utilizes hot air, heated metal bars, electrical impulse sealing bars, ultrasonics, or the like to form a continuous seal between inner flanges 44 and 46 of fastener strips 520 and 510 to the respective side walls of the flexible recloseable container. The various guiding, driving, and other mechanisms of apparatus 700 in contact with the fastener strips from supply 606 are adapted to accommodate the size and location of sliders 530. Because apparatus 700 is provided with a supply 606 of fastener strips with sliders already attached, apparatus 700 does not need the vibrating bowl 110, channel 112, or slider application machine of apparatus 200. The various presealing, sealing, and cutting mechanisms are preferably operated by a controller (not shown) which accomplishes these tasks in spatial relationship to position marks 560, as discussed previously.

Figure 15:
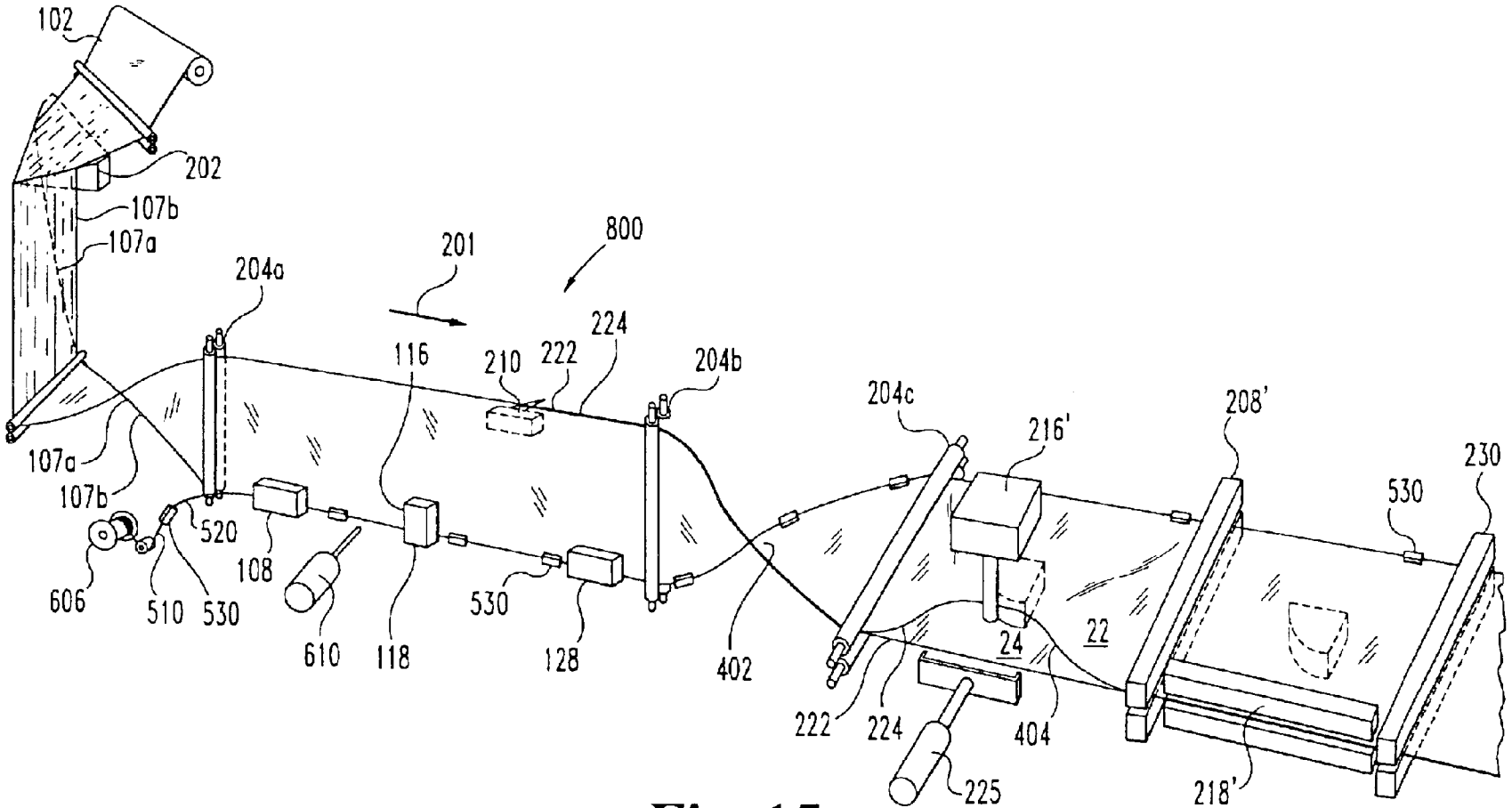
FIG. 15 is a perspective schematic representation of apparatus 800, another embodiment of the present invention, for forming, filling, and sealing a container in a substantially horizontal manner.

FIG. 15 is a perspective schematic of apparatus 800, one embodiment of the present invention, for forming, filling, and sealing a container in a substantially horizontal manner. Apparatus 800 is substantially similar to apparatus 400, except as adapted and described herein. Sealing mechanism 108, as previously described, forms a continuous seal between inner flanges 44 and 46 and fastener strips 520 and 510 to the respective side walls of a flexible recloseable container. The various guiding mechanisms, driving, and other mechanisms of apparatus 800 in contact with the fastener strips from supply 606 are adapted to accommodate the size and location of sliders 530. Because apparatus 800 is provided with a supply 606 of fastener strips with sliders already attached, apparatus 800 does not need the vibrating bowl 110, channel 112, or slider application machine of apparatus 400. The various presealing, sealing, and cutting mechanisms are preferably operated by a controller (not shown) which accomplishes these tasks in spatial relationship to position marks 560, as previously described. Both apparatus 800 and apparatus 700 are considerably simplified from apparatuses 400 and 200, respectively, by removing and relocating the functions performed by various apparatus including sealing horn 120 and sealing plate 122, second sealing mechanism 128, and other devices, their removal and relocation being made possible by the use of apparatus 500 (FIG. 7).

Apparatus 600 (FIG. 13), apparatus 700 (FIG. 14), and apparatus 800 (FIG. 15) can be either intermittent or continuous in operation when using supply 606 of fastener profiles to which a plurality of sliders are coupled. For example, the supply of web 102 of plastic film in apparatus 600, 700, and 800 can be intermittent, with the supply of web stopping for various operations such as forming a transverse seal, cutting of transverse seals, insertion of a product within the web, and other operations. Also, the supply of web 102 of plastic film in apparatus 600, 700, and 800 can be continuous, with the supply of web not stopping for various operations such as forming a transverse seal, cutting of transverse seals, insertion of a product within the web, and other operations, such that the apparatus utilized for performing these operations include movement along the path of the web so that the web does not need to stop.

Although various embodiments of the present invention have been shown and described in conjunction with form, fill, and seal apparatus and methods, those of ordinary skill in the art will recognize that the present invention also contemplates embodiments used in conjunction with apparatus and methods for manufacturing an empty, flexible, recloseable container. As examples of such apparatus and methods, the manufacture of such empty containers would not necessarily use the various machines described for slitting the web, placing a product in the web, or resealing the web after placing the product in the web.

Figure 17:
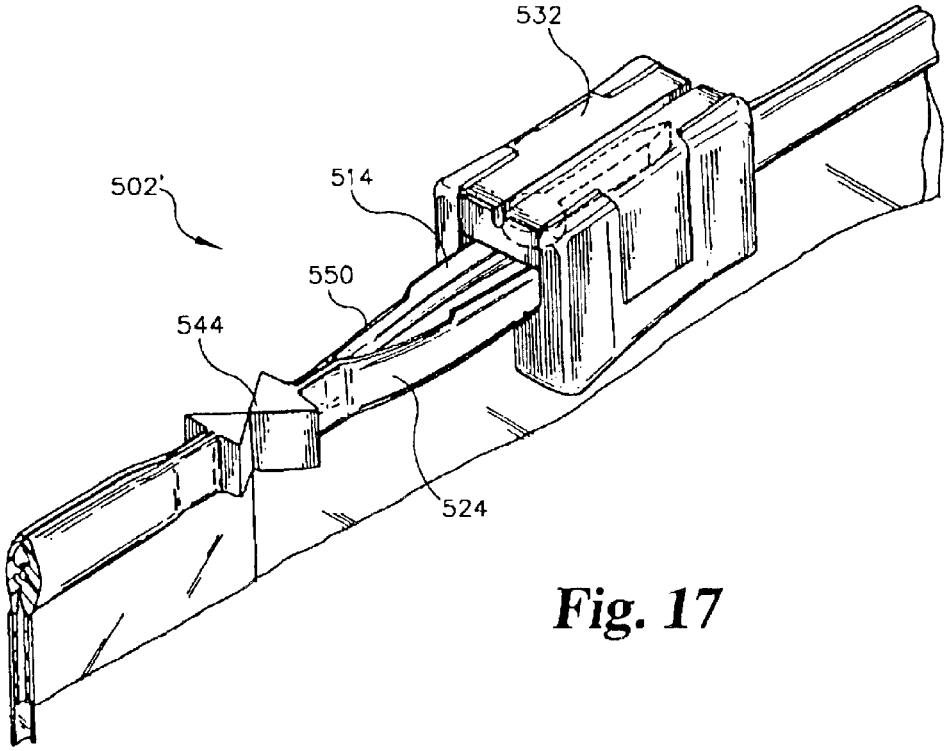
FIG. 17 is a perspective view of a portion of an apparatus according to another embodiment of the present invention.

FIGS. 17, 18, 19, and 20 depict alternate embodiments of the endstops and sliders described herein. FIG. 17 is a perspective view of an embodiment 502' incorporating an alternative endstop 544. Endstop 544 is also described in U.S. Pat. No. 5,131,121.

Figure 18:
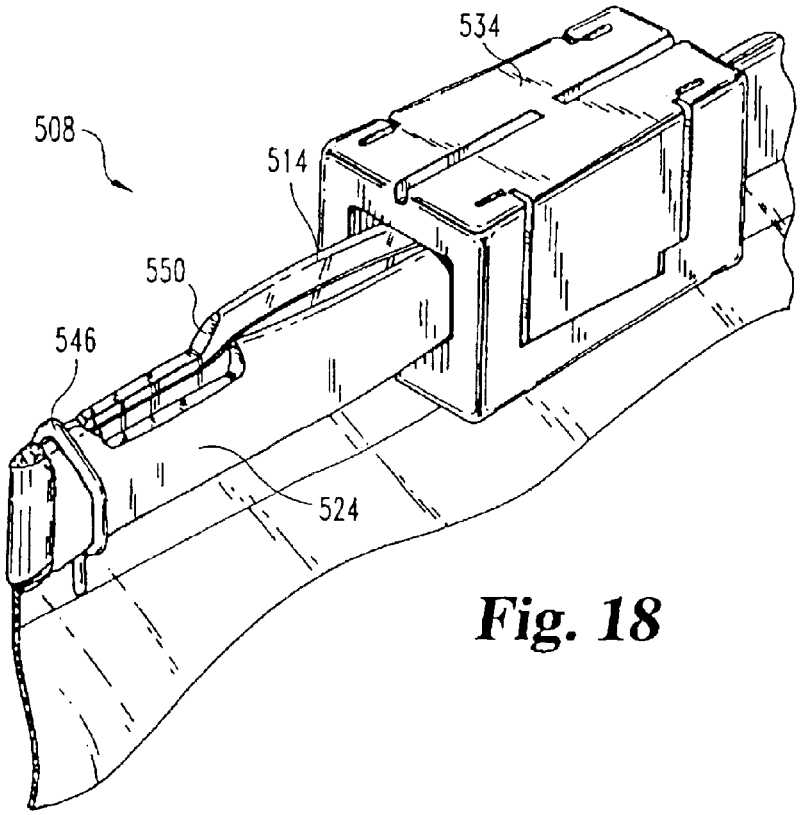
FIG. 18 is a perspective view of a portion of an apparatus according to another embodiment of the present invention.
Figure 19:
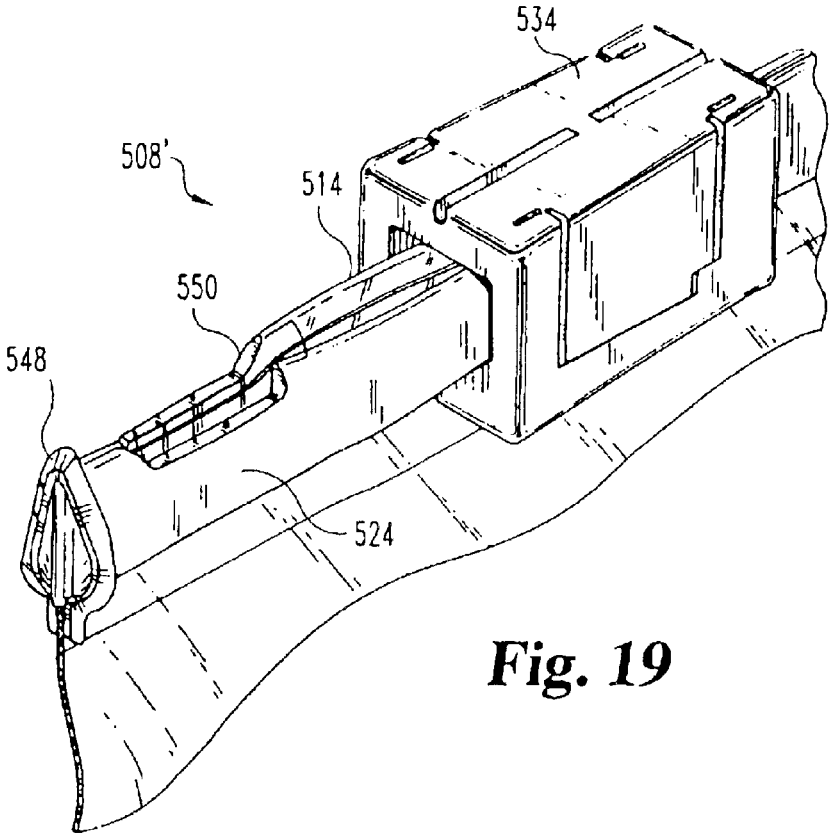
FIG. 19 is a perspective view of a portion of an apparatus according to another embodiment of the present invention.
Figure 20:
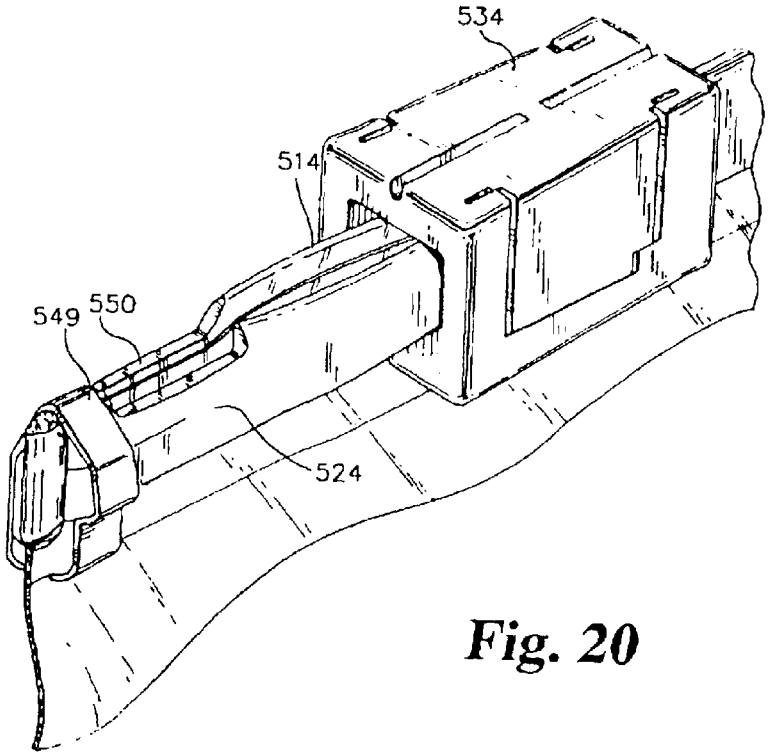
FIG. 20 is a perspective view of a portion of an apparatus according to another embodiment of the present invention.

FIG. 18 is a perspective view of a portion of an apparatus 508 comprising a pair of interlockable fastener strips 514 and 524, a docking station 550, a slider 534, and an endstop 546. Apparatus 508 incorporates plastic monofilament endstops 546, as described in U.S. Pat. No. 5,833,791. FIG. 19 is a perspective view of apparatus 508', which is substantially similar to apparatus 508 but instead incorporating endstop 548. Endstop 548 is preferably fabricated from a softened or melted plastic material by a pair of chilled anvils, as is described more fully in U.S. Pat. No. 5,833,791.

Figure 21:
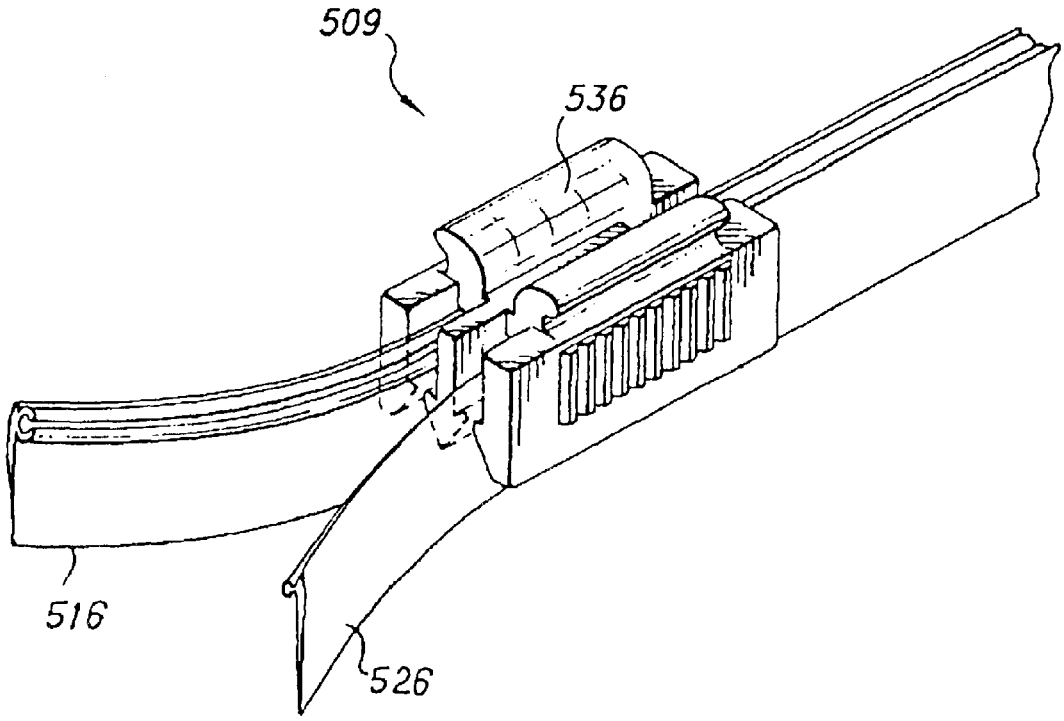
FIG. 21 is a perspective view of a portion of an apparatus according to another embodiment of the present invention.
Figure 23B:
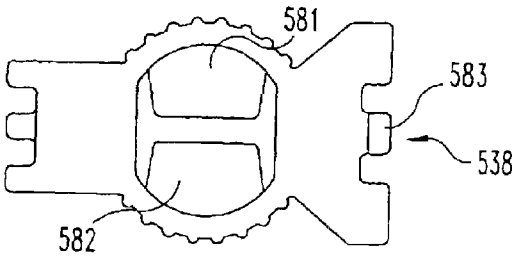
FIG. 23B is a top plan view of the slider of the FIG. 23A.
Figure 23A:
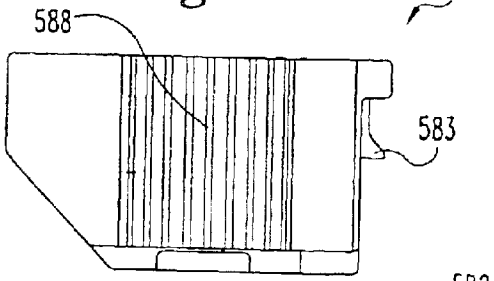
FIG. 23A is a side elevational view of a slider useful with the present invention.
Figure 23E:
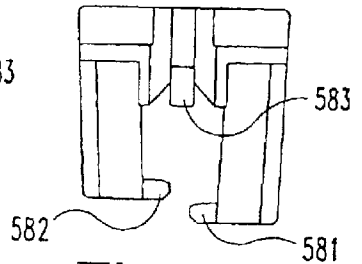
FIG. 23E is a rear elevational view of the slider of FIG. 23A.
Figure 23C:
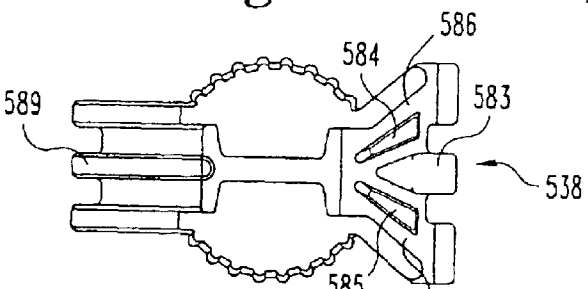
FIG. 23C is a bottom plan view of the slider of FIG. 23A.
Figure 23D:
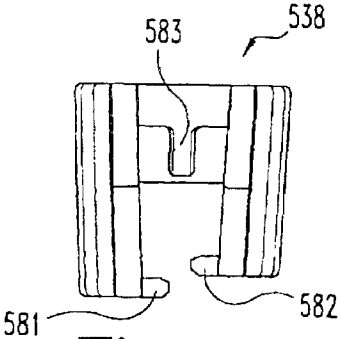
FIG. 23D is a front elevational view of the slider of FIG. 23A.

FIG. 21 is a perspective view of a portion of an apparatus 509 according to another embodiment of the present invention. Apparatus 509 includes a pair of interlockable fastener strips 516 and 526 and a slider 536 mounted in straddling relationship thereto. Fastener strips 516 and 526 and slider 536 are described more fully in U.S. Pat. No. 4,262,395. Any of the various endstops, docking stations, or position marks as described herein may also be incorporated in apparatus 509.

FIGS. 23A, 23B, 23C, 23D, and 23E depict a slider 538 useful in the present invention. Slider 538 includes a pair of opposing guides 581 and 582 for securing slider 538 to features such as shoulders 45 and 47 of fastener strips 512 and 522, respectively. Slider 538 includes a center separator 583 for stabilizing slider 538 within or near a docking station. During opening, the fastener strips are spread apart by spreading members 584 and 585, with the unlocked fastener strips being guided within channels 586 and 587. A knurled center section 588 permits easy gripping by hand of the slider. A guiding member 589 on the closing end of slider 538 guides slider 538 between portions 513 and 523 of fastener strips 512 and 522 (FIG. 12), respectively.

FIGS. 25–35 depict various embodiments of the present invention coupled with tamper-evident seals. The following embodiments of tamper-evident seals are to be considered as non-limiting examples only, those of ordinary skill in the art recognizing other tamper-evident seals which can be used with fastener strips incorporating a plurality of sliders. For improved clarity, FIGS. 27–35 do not include the slider attached to the fastener profiles, and in some cases the fastener profiles are unlocked and spread apart.

It is intended that embodiments of the present container with tamper-evident seals be used in situations where the bag is filled at the factory with a product and then marketed to the consumer. The consumer buys the bag and is reassured that it has not been tampered with because the tamper-evident seal is in place and needs to be ruptured before the consumer can use the contents of the bag. If the consumer does not wholly consume the contents he can then reclose the bag and use it further to contain the partially filled bag. The present invention also contemplates those embodiments which do not include a tamper-evident seal, including both those embodiments sold with a product in the bag and those embodiments in which the bag is sold in the empty state.

Figure 25:
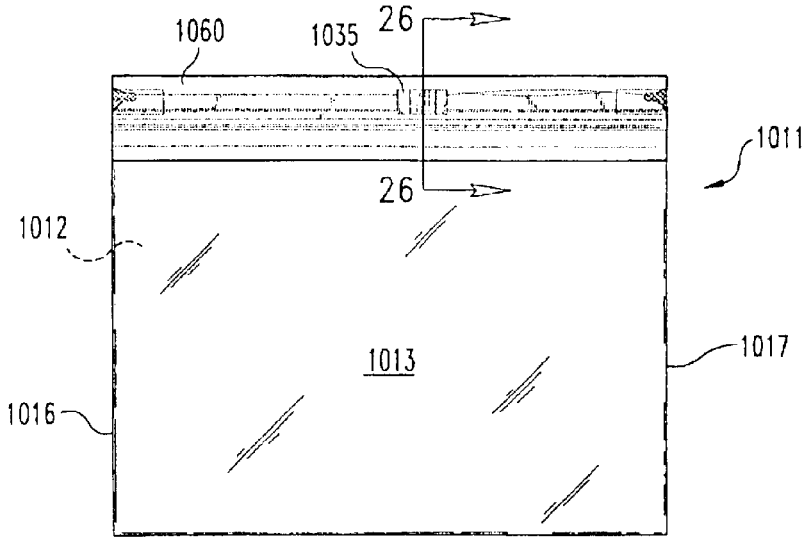
FIG. 25 is a side elevational view of a flexible recloseable container according to one embodiment of the present invention with a tamper evident seal.
Figure 26:
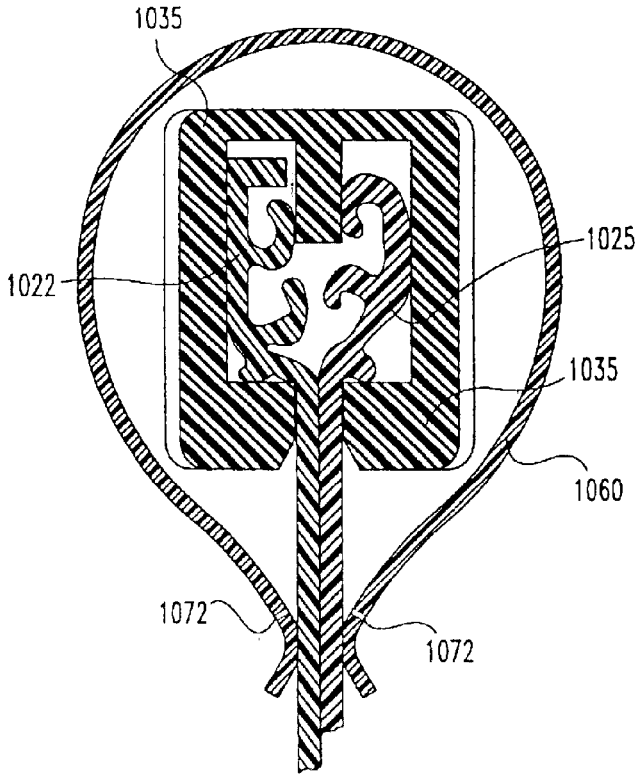
FIG. 26 is a cross sectional view of the container of FIG. 25 as taken along line 25—25 of FIG. 25.
Figure 28:
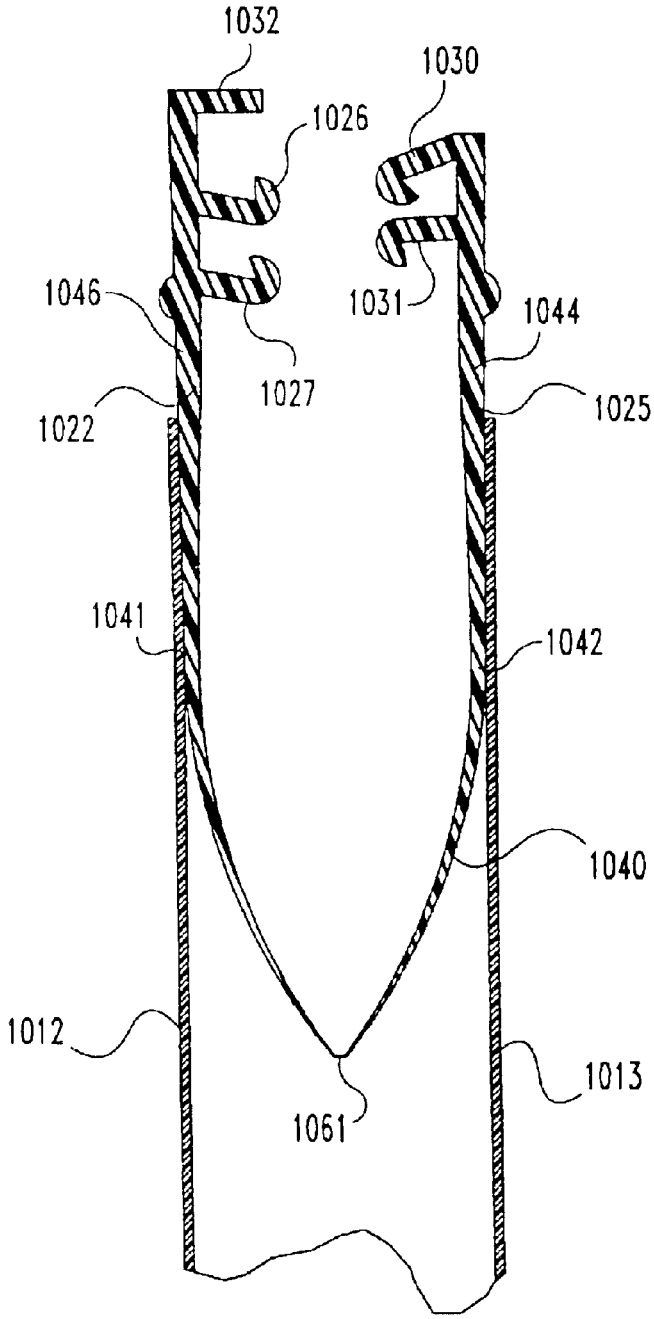
FIG. 28 is an enlargement of the seal portion of the container of FIG. 27.

Referring now to FIGS. 25–26, a flexible recloseable container 1011 is illustrated which consists of a pair of side walls 1012 and 1013 which are connected together at the bottom and at the sideward edges 1016 and 1017 of the bag. Container 1011 is identical to container 20 except as described herein. The fastener includes a pair of fastener strips 1022 and 1025 which are secured at their flanges 1041 and 1042 to the side walls 1012 and 1013 and include reclosable interlocking profile elements 1026, 1027, 1030 and 1031, as best seen in FIG. 28. The reclosable fastener further includes a flange 1032 which functions to close over the top of the fastener when it is in the closed position. Fastener strips 1022 and 1025 are identical to fastener strips 510 and 520, except as hereafter shown and described. Fastener strips 1022 and 1025 include interlocking profile elements which are arranged to project from side flanges 1044 and 1046 at non-perpendicular angles, as best seen by comparing FIG. 28 to FIG. 11. Further, fastener strips 1022 and 1025 are modified as described herein to accommodate the various tamper-evident closures described.

Referring to FIGS. 25–26, a slider 1035 is arranged to straddle the fastener strips 1022 and 1025 for opening and closing the fastener. Slider 1035 is identical to slider 530, except for any modifications that might be necessary to accommodate fastener strips 1022 and 1025 and the various tamper-evident closures shown herein. Slider 1035 is placed on fastener strips 1022 and 1025 prior to attachment of fastener strips 1022 and 1025 to a web of flexible film, the attachment forming a flexible recloseable container in a manner identical to that previously described. The tamper evident slider bag of FIG. 26 includes a tamper-evident seal 1060 which forms a hood that covers and surrounds fastener strips 1022 and 1025 as well as slider 1035 of the bag of FIGS. 26 and 25. In certain situations, the embodiment of FIG. 26 will be provided with perforations 1072 which facilitate removing the tamper evident sheet 1060. If desired, perforations may also be provided in the embodiment of FIGS. 27 and 28, such as, for example, at location 1061.

Figure 27:
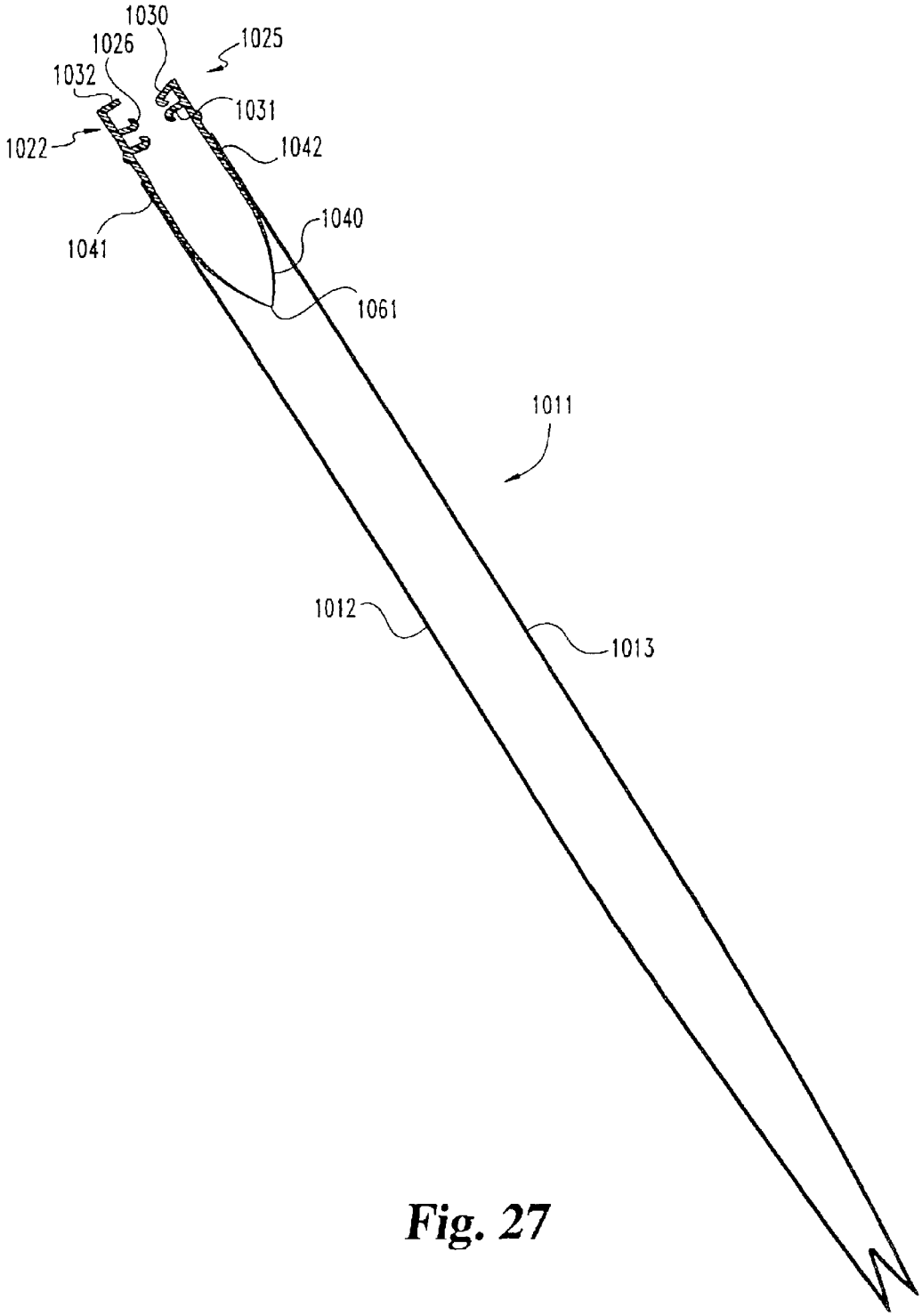
FIG. 27 is a cross sectional view of the container of FIG. 25 with an alternate tamper evident seal.

Referring to FIGS. 27 and 28, fastener strips 1022 and 1025 are shown formed homogeneously and co-extensively therewith a tamper-evident seal 1040 comprising a sheet of plastic interconnecting the two fastener strips. This tamper evident seal 1040 may be extruded along with the fastener elements 1022 and 1025 but has a somewhat less thick construction than the strips 1022 and 1025 in particular the web portions 1041 and 1042 thereof.

Figure 29:
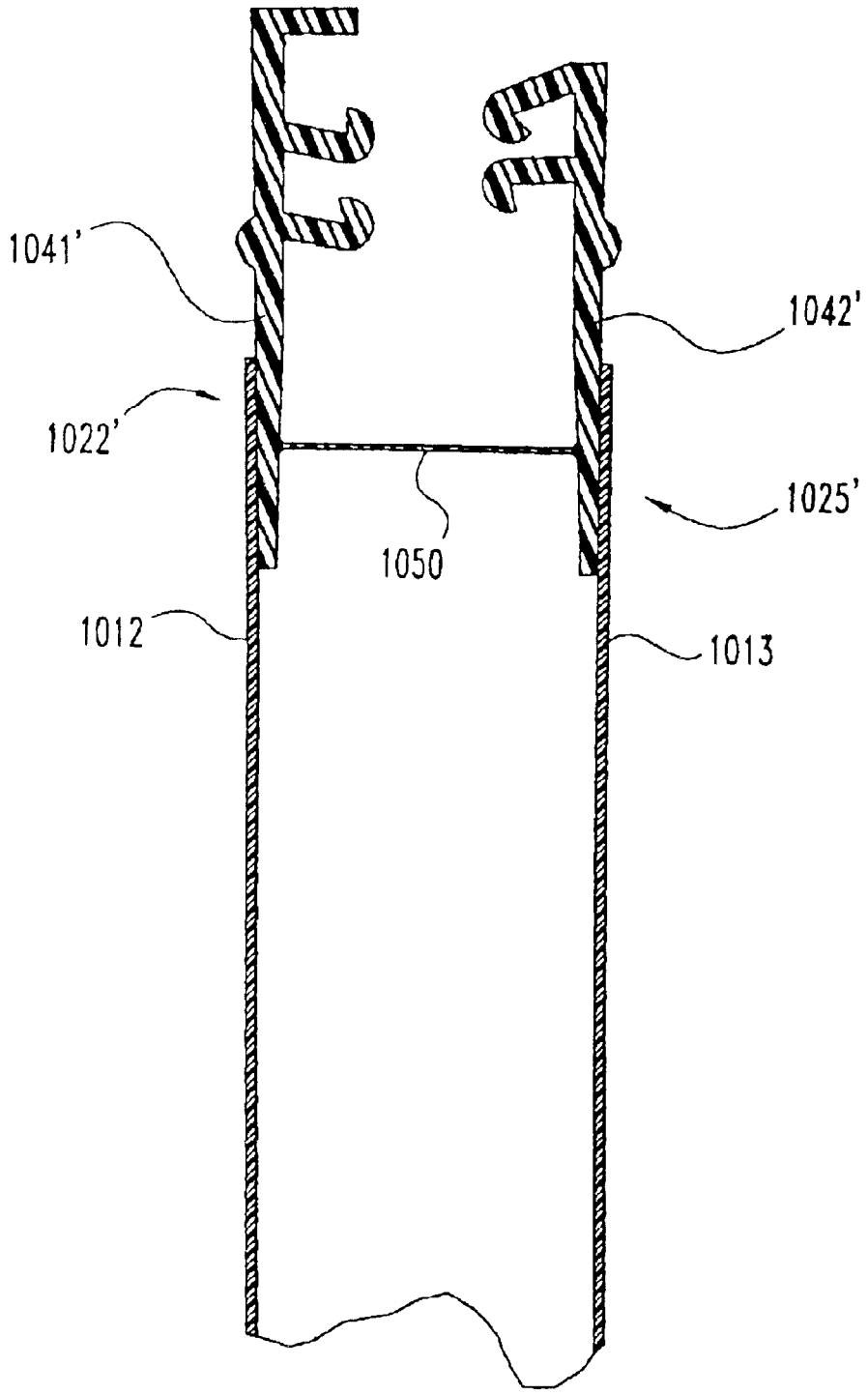
FIG. 29 is an enlargement of the seal portion of a container according to one embodiment of the present invention with an alternate tamper evident seal.

FIG. 29 shows an alternative embodiment of the reclosable fastener of FIGS. 27 and 28, and includes a tamper evident closure 1050 that extends between the flanges 1041' and 1042' of the reclosable fastener elements 1022' and 1025'. The construction of closure 1050 of FIG. 29 is preferably extruded.

Figure 30:
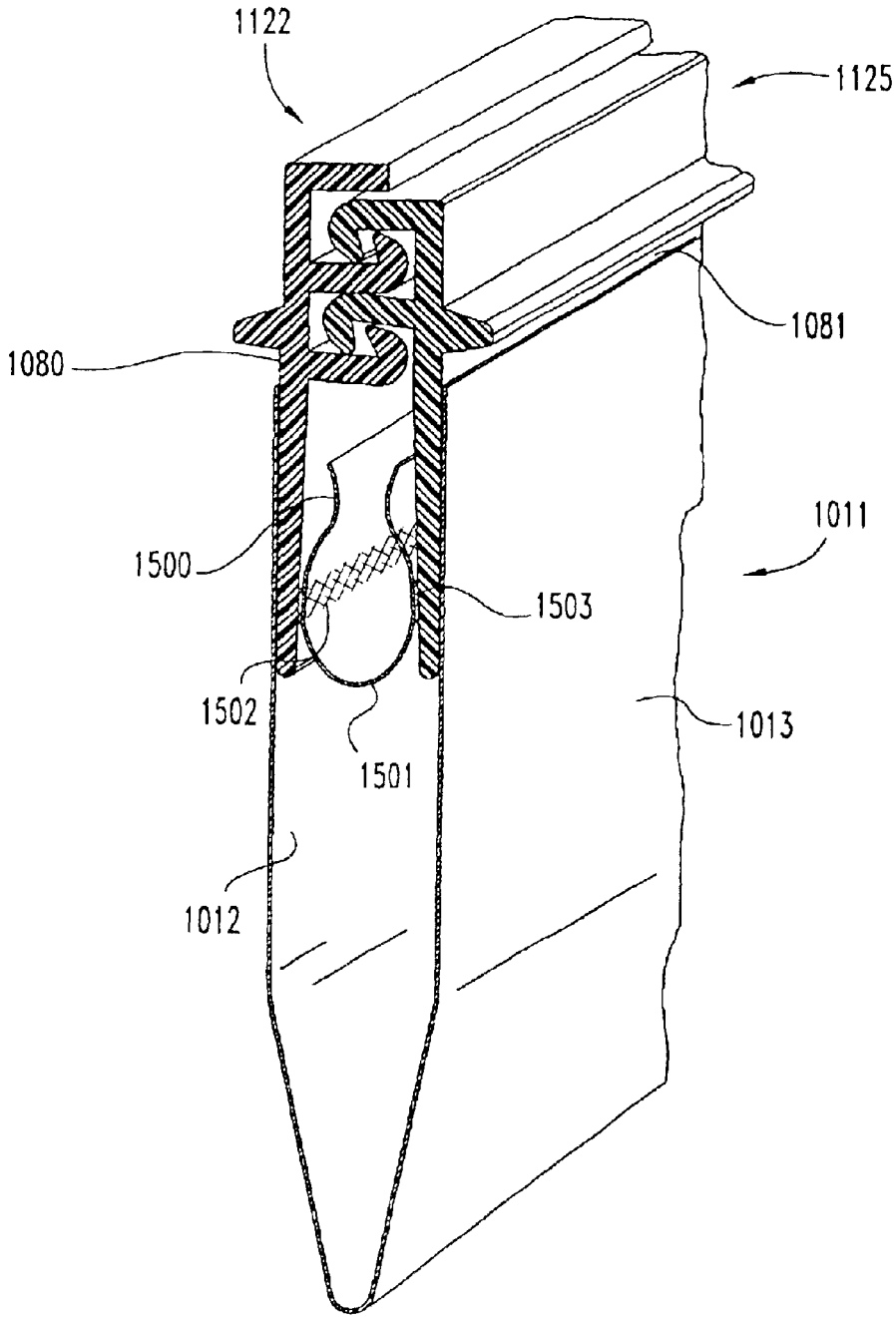
FIG. 30 is a perspective cross sectional view of a container according to one embodiment of the present invention with an alternate tamper evident seal.

FIG. 30 depicts a plastic film bag wherein side wall 1012 is secured to outer face 1080 of fastener strip 1122 and side wall 1013 is secured to outer face 1081 of fastener strip 1125. Fastener strips 1122 and 1125 are identical to fastener strips 510 and 520, except as hereafter shown and described. A sheet of plastic film is disposed between side walls 1012 and 1013 and, in this embodiment, is also disposed between the pair of flexible plastic strips 1122 and 1125, this sheet of plastic film forming tamper-evident seal 1500. Seal 1500 preferably has at least one curved region 1501 and is typically secured to the pair of fastener strips 1122 and 1125 by adhesive strips 1502 and 1503, respectively. However, seal 1500 may be secured to the pair of flexible plastic strips by other methods known in the art, including heat sealing. As discussed when describing the other embodiments, seal 1500 may have a plurality of perforations for facilitating its rupture or may simply be cut through. Alternatively, depending on the strength of the adhesive used, seal 1500 may be manually removed for entry into the bag.

Figure 31:
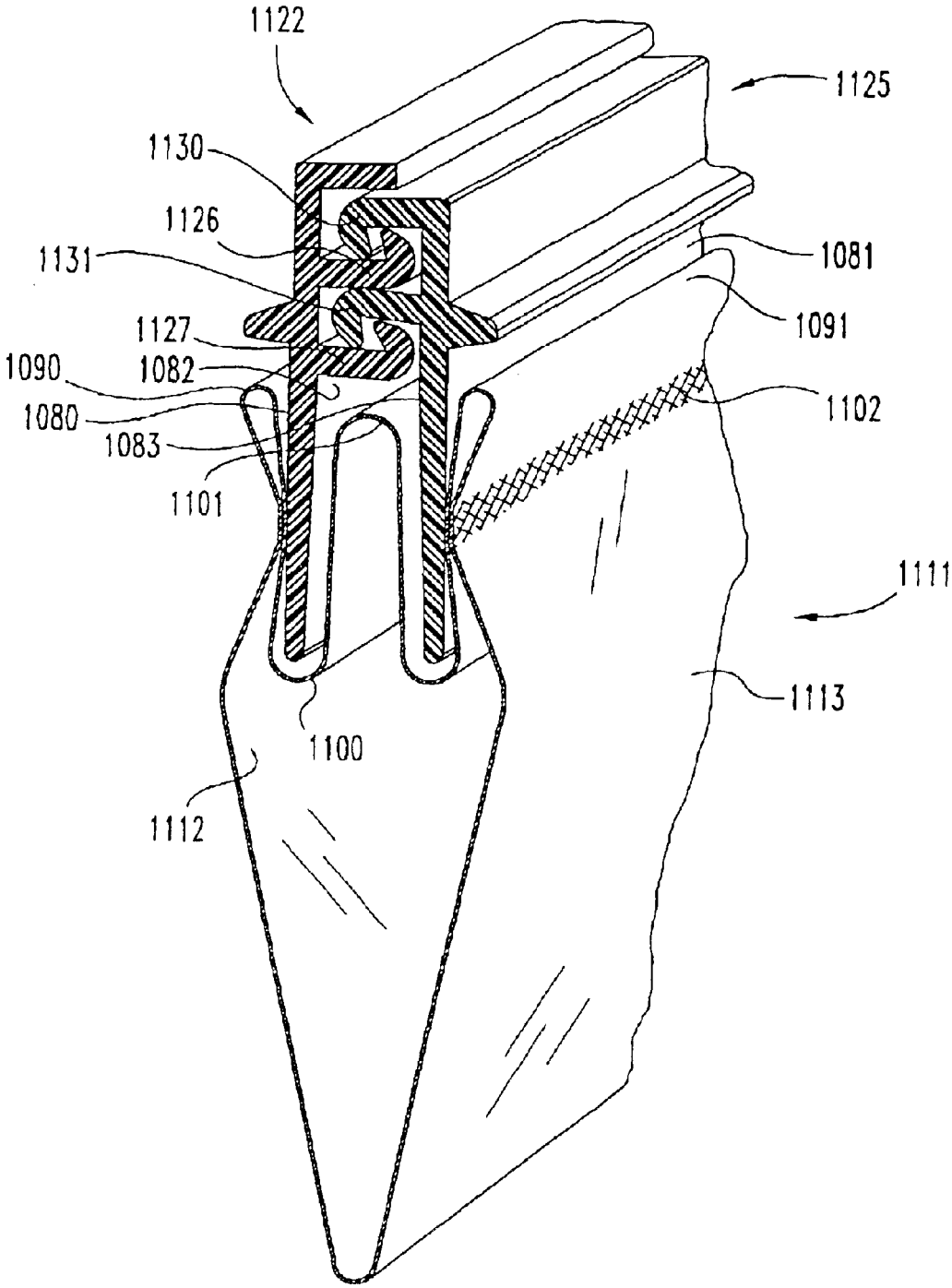
FIG. 31 is a perspective cross sectional view of a container according to one embodiment of the present invention with an alternate tamper evident seal.

In the embodiment shown in FIG. 31, side wall 1113 is secured to outer face 1081 of fastener strip 1125 at region 1102 and side wall 1112 is secured to outer face 1080 of fastener strip 1122 at a similar location (not shown). The side walls may be secured to the flexible plastic strips by methods known in the art, including heat sealing and use of adhesives. Upper regions 1090 and 1091 of side walls 1112 and 1113, respectively, form a sheet of plastic film disposed between the sidewalls that acts as a tamper-evident seal 1100.

In forming seal 1100, each of the pair of side walls 1112 and 1113 folds over itself as seen at upper regions 1090 and 1091. Seal 1100 typically extends along planes parallel to a plane passing between inner face 1082 and outer face 1080 of fastener strip 1122 and a plane passing between inner face 1083 and outer face 1081 of fastener strip 1125. However, seal 1100 may also extend along planes oblique or a plane perpendicular to a plane passing between inner face 1082 and outer face 1080 of fastener strip 1122 and a plane passing between inner face 1083 and outer face 1081 of fastener strip 1125 in this and the other embodiments discussed. Seal 100 preferably has at least one curved region 1101. The length of side walls 1112 and 1113 that form seal 1100 is typically that which allows the fastener strips to separate from each other a greater distance when the profile elements 1126, 1127, 1130 and 1131 are in a non-interlocked configuration and can be determined by one skilled in the art. In this way, seal 1100 acts as a gusset, thus allowing easier access to the film of plastic film bag 1111.

Tamper evident seal 1100 preferably has a plurality of perforations for facilitating its rupture. The plurality of perforations is preferably located in curved region 101 but may be located at other places on seal 1100 as one skilled in the art would appreciate. Alternately, seal 1100 may be ruptured by cutting by the consumer.

Figure 32:
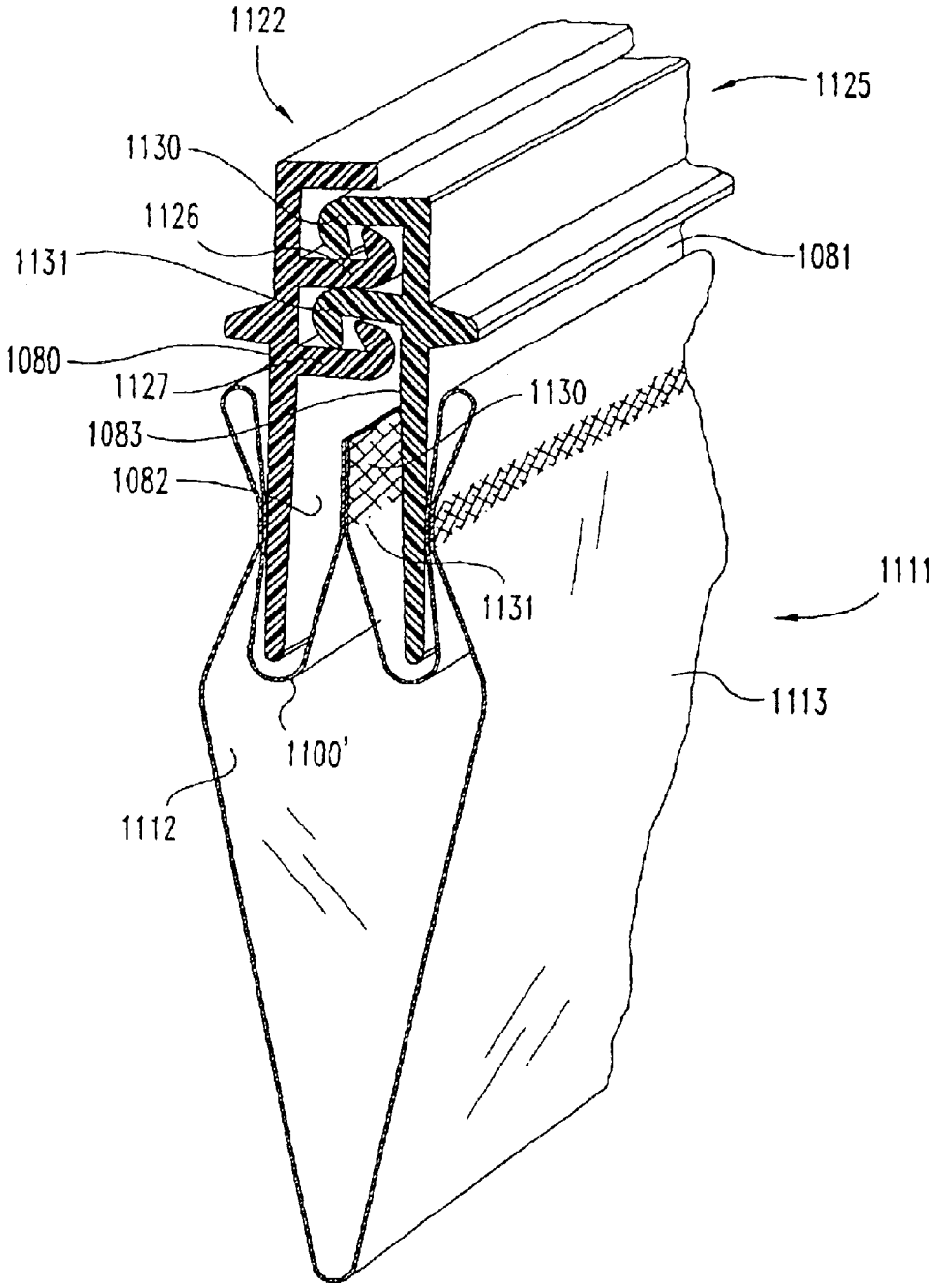
FIG. 32 is a perspective cross sectional view of a container according to one embodiment of the present invention with an alternate tamper evident seal.

The embodiment depicted in FIG. 32 is identical to that shown in FIG. 31 with the exception that curved region 1101 of tamper-evident seal 1100' is replaced by a double layer of film joined together and defining a joint 1130 that extends along the length of seal 1100'. Joint 1130 may involve the two ends of film being secured together or may involve collapsing and sealing curved region 1101. Base 1131 of joint 1130 may be weakened as a result of formation of the joint and thereby allow one to grasp and tear the seal to open bag 1111. The ability to tear joint 1130 to rupture seal 1100' depends on the film thickness and the extent to which formation of joint 1130 has weakened base 1131 of seal 1100' or the area around the base of joint seal 1100'. Alternatively, a plurality of perforations may be placed near or along base 1131 of joint 1130 to aid in rupturing the seal. Seal 1100' may also be ruptured by cutting.

Figure 33:
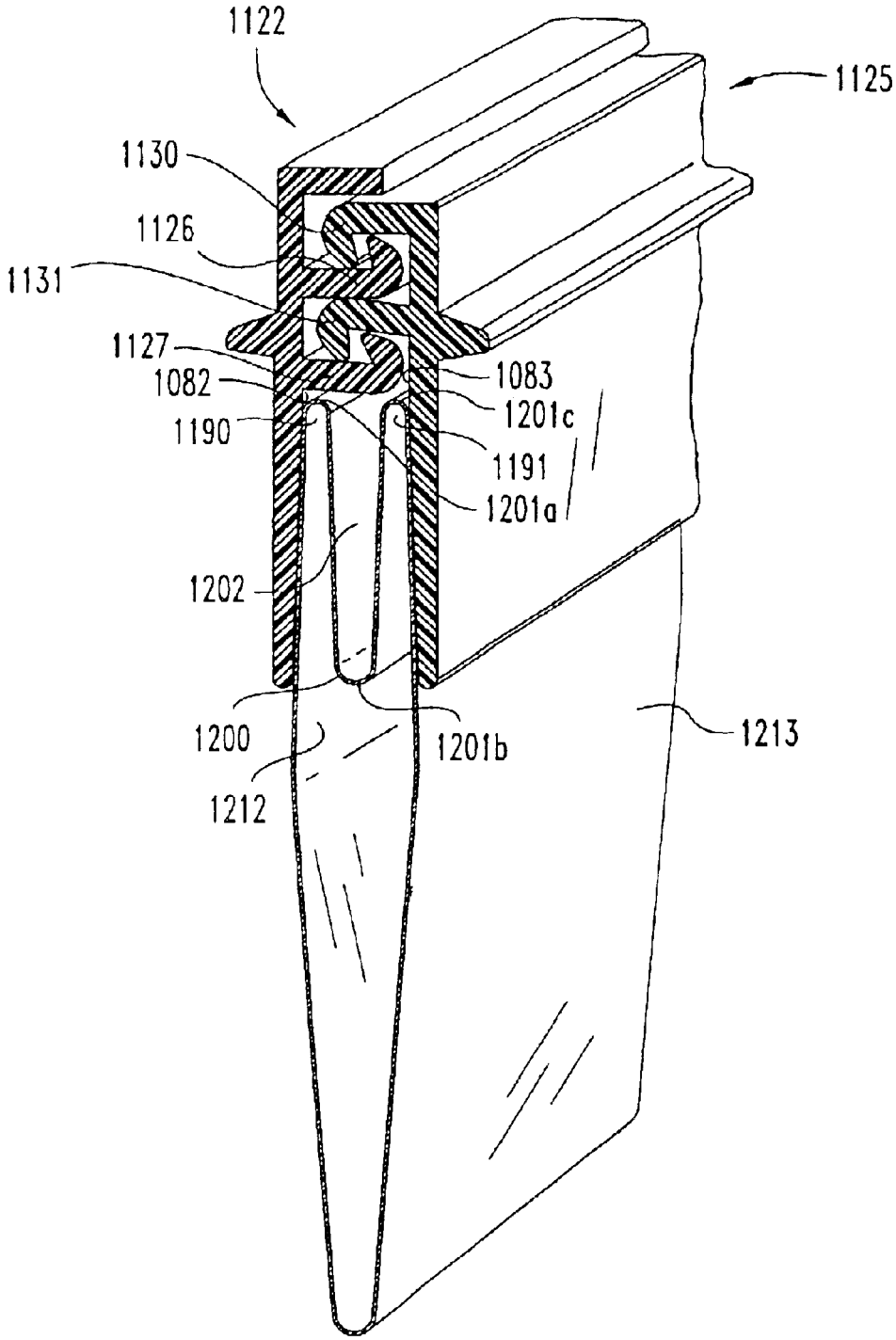
FIG. 33 is a perspective cross sectional view of a container according to one embodiment of the present invention with an alternate tamper evident seal.

In the embodiment shown in FIG. 33, side wall 1212 is secured to inner face 1082 of fastener strip 1122 and side wall 1213 is secured to inner face 1083 of fastener strip 1125. The regions of the side walls closest to profile element 1127, upper regions 1190 and 1191 of side walls 1212 and 1213, respectively, form a sheet of plastic film disposed between the side walls that is tamper-evident seal 1200. Seal 1200 is further disposed between the fastener strips 1122 and 1125. Seal 1200 preferably has at least one curved region. In the embodiment shown in FIG. 33, seal 1200 has three curved regions 1201*a*–1201*c* and includes a U-shaped region 1202 that functions as a gusset. Seal 1200 and slider 1035 (not shown in FIG. 33) do not interfere with each other in this and the other tamper evident seal embodiments shown herein.

The sheet of plastic seal 1200 preferably has a plurality of perforations for facilitating its rupture. The plurality of perforations is preferably located in any of the curved regions 1201*a*–1201*c* but may be located at other places on seal 1200 as one skilled in the art would appreciate. Alternately, seal 1200 may be ruptured by cutting.

Figure 34:
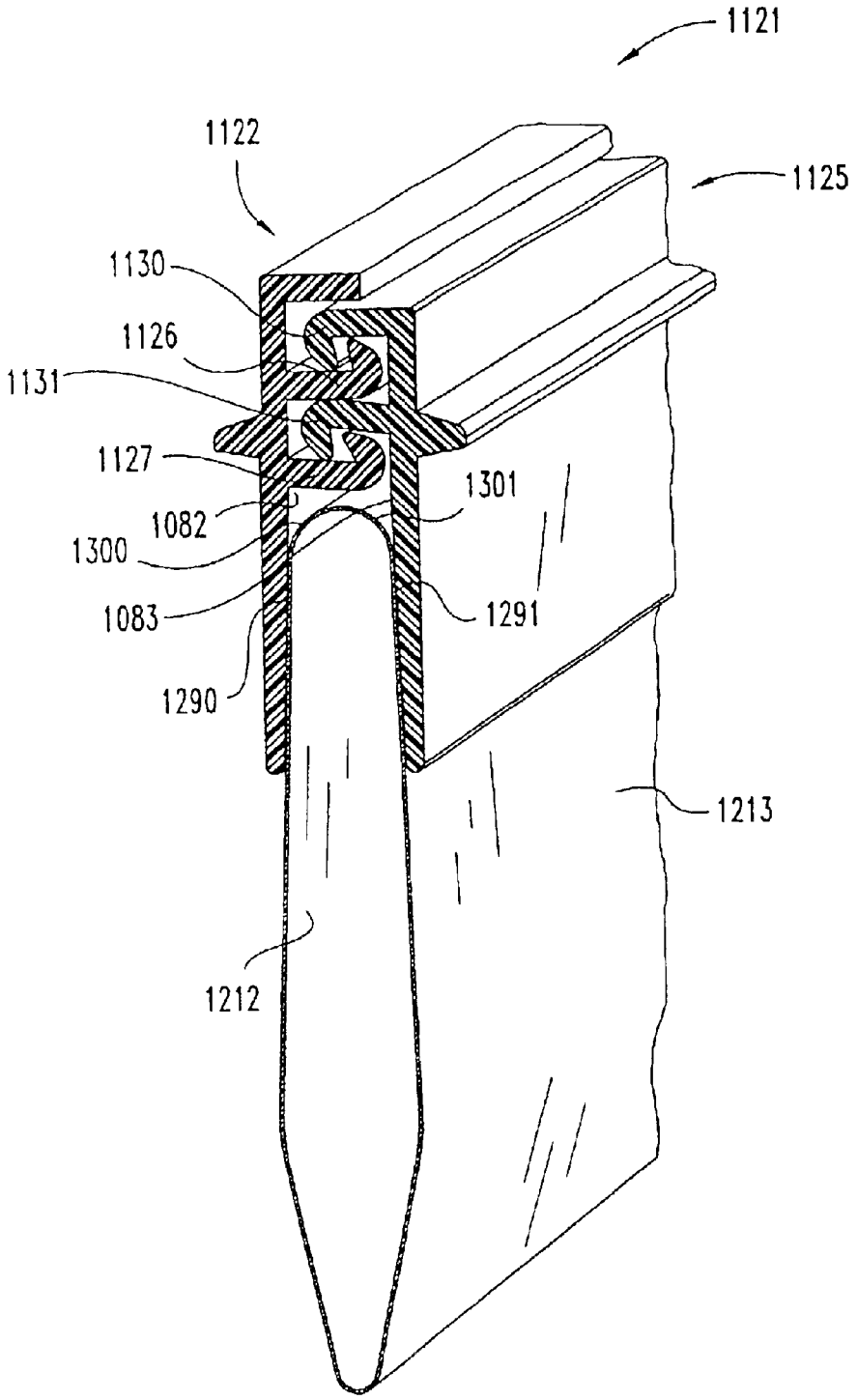
FIG. 34 is a perspective cross sectional view of a container according to one embodiment of the present invention with an alternate tamper evident seal.

The embodiment shown in FIG. 34 is similar to that shown in FIG. 33 except that tamper-evident seal 1300 includes only one curved region 1301. Side walls 1212 and 1213 are secured to inner faces 1082 and 1083 of fastener strips 1122 and 1125, respectively. This configuration allows for minimal spreading of fastener 1121. That is, the flexible plastic strips of fastener 1121 minimally spread from each other when the rib and groove profile elements 1126, 1127, 1130 and 1131 are in a non-interlocked configuration. Moreover, less excess film is present in this embodiment, thus minimizing interference of the film with the fastener and reducing the cost of material.

Tamper-evident seal 1300 preferably has a plurality of perforations for facilitating its rupture. The plurality of perforations is preferably located at curved region 1301 but may be located at other places on seal 1300 as one skilled in the art would appreciate. Alternately, seal 1300 may be ruptured by cutting.

Figure 35:
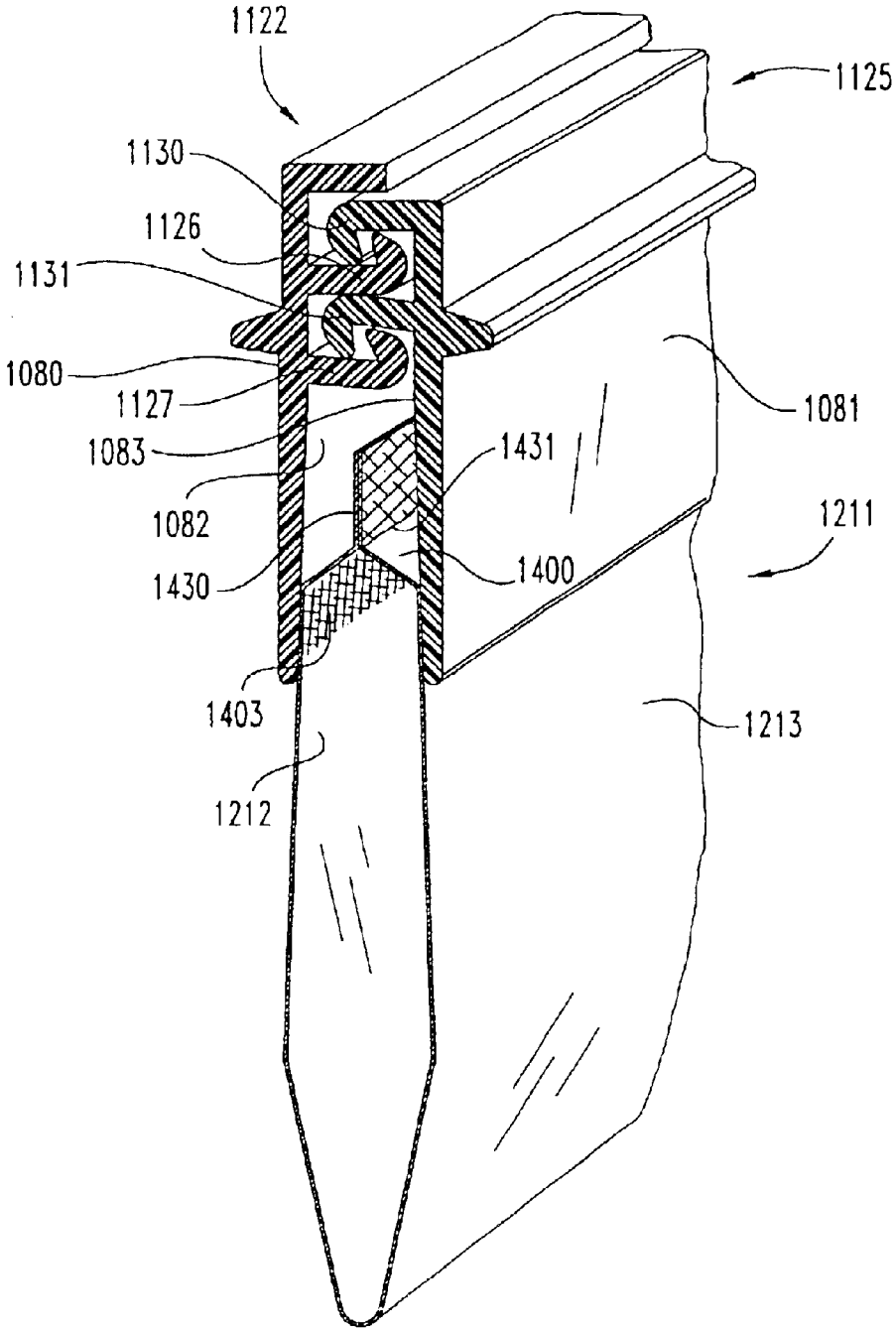
FIG. 35 is a perspective cross sectional view of a container according to one embodiment of the present invention with an alternate tamper evident seal.

FIG. 35 shows an embodiment of the present invention incorporating a tamper-evident seal 1400. The seal embodiment shown in FIG. 35 is identical to that shown in FIG. 34, except as herein described. One difference in these two embodiments is that the region of side walls 1212 and 1213 that are secured are more distant from profile element 1127 than the region of side walls secured in the embodiment shown in FIG. 34. Specifically, region 1403 of side wall 1212 is secured to inner face 1082 of fastener strip 1122 and a similar region (not shown) of side wall 1213 is secured to inner face 1083 of fastener strip 1125. One other difference in this embodiment compared to that shown in FIG. 34 is that curved region 1301 is replaced by a double layer of film joined together and defining a joint 1430 that extends along the width of tamper-evident seal 1400. Joint 1430 may involve the two ends of film being secured together or may involve collapsing and sealing curved region 1301 in FIG. 34. Furthermore, it can be seen that seal 1400 extends along planes oblique to a plane passing between inner face 1082 and outer face 1080 of fastener strip 1122 and a plane passing between inner face 1083 and outer face 1081 of fastener strip 1125.

Base 1431 of joint 1430 may be weakened as a result of formation of the joint and may allow one to grasp and tear the seal to open bag 1211. Alternatively, a plurality of perforations may be placed along base 1431 of seal 1400 to aid in rupturing the film. Seal 1400 may also be ruptured by cutting.

It is to be noted that the sheet of flexible plastic film disposed between the side walls can have regions other than curved regions, including pleats and other forms of folds that will act as a gusset.

Although what has been shown and described are various apparatus 500, 502, 502', 504, 506, 508, 508', and 509 with particular combinations of fastener strips, sliders, endstops, docking stations, tamper evident seals, and position marks as specifically described, those of ordinary skill in the art will recognize that these features of the various apparatus may be combined differently. As but one example, fastener strips 510 and 520 could include any of the various endstops shown herein, and their equivalents.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of manufacturing a reclosable package comprising a zipper closure and a slider device, the method comprising:

(a) providing an extended length of a zipper closure construction, the zipper closure construction comprising:

(i) a first interlocking closure profile and a second interlocking closure profile, each of the closure profiles having a distal end and a sealing flange disposed opposite the distal end;

(ii) a slider device operably mounted on the zipper closure; the slider device constructed and arranged to interlock the first closure profile with the second closure profile when the slider device is moved in a first direction, and to disengage the first closure profile from the second closure profile when the slider device is moved in a second opposite direction, the slider device mounted on the distal ends of the closure profiles;

(iii) a first tamper-evident structure enveloping the slider device;

(iv) a second tamper-evident structure enveloping the sealing flanges of the closure profiles;

(b) sealing the extended length of zipper closure to a surrounding wall; and (c) creating edges to form a package interior.

2. The method of claim 1 wherein the first tamper evident structure envelopes the distal ends of the closure profiles.

3. An extended length of a zipper closure comprising:

(a) a first interlocking closure profile and a second interlocking closure profile, each of the closure profiles having a distal end and a sealing flange positioned opposite the distal end;

(b) a slider device operably mounted on the first and second closure profiles; the slider device constructed and arranged to interlock the first closure profile with the second closure profile when the slider device is moved in a first direction, and to disengage the first closure profile from the second closure profile when the slider device is moved in a second opposite direction, the slider device mounted on the distal ends of the closure profiles; and (c) an envelope encasing the first and second closure profiles and the slider device mounted thereon, the envelope comprising:

(i) a first tamper-evident structure positioned over the slider device, the first tamper evident-structure connected to the sealing flanges; and (ii) a second tamper-evident structure connected to the sealing flanges.

4. The zipper closure of claim 3 wherein the first tamper evident structure is positioned over the distal ends of the closure profile.

* * * * *